US009219325B2

(12) United States Patent
Endo et al.

(10) Patent No.: US 9,219,325 B2
(45) Date of Patent: Dec. 22, 2015

(54) ELECTRIC CONNECTOR INCLUDING CONNECTOR TERMINAL WITH BUFFER PORTION

(71) Applicant: DAI-ICHI SEIKO CO., LTD., Kyoto (JP)

(72) Inventors: Takayoshi Endo, Shizuoka (JP); Sakai Yagi, Shizuoka (JP); Masaya Muta, Shizuoka (JP); Shunya Oohashi, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 141 days.

(21) Appl. No.: 14/030,212

(22) Filed: Sep. 18, 2013

(65) Prior Publication Data

US 2014/0087592 A1 Mar. 27, 2014

(30) Foreign Application Priority Data

Sep. 25, 2012 (JP) ..... 2012-211374

(51) Int. Cl.

| | |
|---|---|
| ***H01R 12/00*** | (2006.01) |
| ***H01R 13/46*** | (2006.01) |
| ***H01R 12/73*** | (2011.01) |
| ***H01R 12/91*** | (2011.01) |

(52) U.S. Cl.

CPC ..... *H01R 13/46* (2013.01); *H01R 12/73* (2013.01); *H01R 12/91* (2013.01)

(58) Field of Classification Search

USPC ..... 439/246, 74, 78, 81, 75

See application file for complete search history.

(56) References Cited

U.S. PATENT DOCUMENTS

| | | | | | |
|---|---|---|---|---|---|
| 3,864,000 | A | * | 2/1975 | Coller et al. | 439/246 |
| 3,883,212 | A | * | 5/1975 | Keglewitsch | H01R 4/14 174/94 S |
| 4,470,648 | A | * | 9/1984 | Davis et al. | 439/68 |
| 4,738,631 | A | * | 4/1988 | Takahashi et al. | 439/248 |
| 4,753,617 | A | * | 6/1988 | Jacobs | 439/825 |
| 4,775,333 | A | * | 10/1988 | Grider et al. | 439/736 |
| 4,810,215 | A | * | 3/1989 | Kaneko | 439/845 |
| 4,870,308 | A | * | 9/1989 | Sismour, Jr. | 310/71 |
| 4,923,405 | A | * | 5/1990 | Munsterman et al. | 439/78 |
| 5,076,796 | A | * | 12/1991 | Kusayanagi et al. | 439/83 |
| 5,122,066 | A | * | 6/1992 | Plossmer | 439/78 |
| 5,167,513 | A | * | 12/1992 | Johnson et al. | 439/78 |
| 5,201,663 | A | * | 4/1993 | Kikuchi et al. | 439/83 |
| 5,306,168 | A | * | 4/1994 | Kunishi | H01R 13/6315 439/248 |
| 5,409,386 | A | * | 4/1995 | Banakis | H01R 12/57 439/567 |
| 5,415,559 | A | * | 5/1995 | Ichimura | H01R 13/2435 439/140 |
| 5,681,192 | A | * | 10/1997 | Kobayashi | H01R 13/055 439/884 |

(Continued)

FOREIGN PATENT DOCUMENTS

| | | |
|---|---|---|
| JP | 58-193474 | 12/1983 |
| JP | 6-068315 | 9/1994 |

(Continued)

*Primary Examiner* — Neil Abrams

(74) *Attorney, Agent, or Firm* — Wenderoth, Lind & Ponack, L.L.P.

(57) ABSTRACT

A connector terminal includes a first contact at one end, a second contact at the other end, and a buffer portion, the connector terminal electrically connecting a first object connected to the first contact to a second object connected to the second object, the buffer portion being bent in accordance with a positional gap between the first and second objects, the buffer portion having a cross-sectional area smaller than the same of the first and second contacts.

7 Claims, 31 Drawing Sheets

(56) References Cited

U.S. PATENT DOCUMENTS

| | | | | |
|---|---|---|---|---|
| 5,683,255 | A * | 11/1997 | Menze | 439/63 |
| 5,713,745 | A * | 2/1998 | Sakurai et al. | 439/78 |
| 5,746,608 | A * | 5/1998 | Taylor | 439/70 |
| 5,807,123 | A * | 9/1998 | Spiegelaar et al. | 439/188 |
| 5,899,767 | A | 5/1999 | Kato et al. | |
| 5,915,979 | A * | 6/1999 | Schell et al. | 439/83 |
| 5,975,921 | A * | 11/1999 | Shuey | 439/83 |
| 6,132,222 | A * | 10/2000 | Wang et al. | 439/70 |
| 6,290,524 | B1 * | 9/2001 | Simmel | 439/289 |
| 7,080,999 | B2 * | 7/2006 | Narui et al. | 439/246 |
| 7,210,225 | B2 * | 5/2007 | Olson et al. | 29/882 |
| 7,322,834 | B2 * | 1/2008 | Hu et al. | 439/83 |
| 7,867,016 | B2 * | 1/2011 | Nabilek et al. | 439/474 |
| 8,272,882 | B2 * | 9/2012 | Sakai et al. | 439/81 |
| 8,574,008 | B2 * | 11/2013 | Groβe et al. | 439/627 |
| 8,690,586 | B2 * | 4/2014 | Schneider | 439/66 |
| 2006/0003616 | A1 | 1/2006 | Narui et al. | |
| 2014/0087592 | A1 * | 3/2014 | Endo et al. | 439/628 |

FOREIGN PATENT DOCUMENTS

| | | |
|---|---|---|
| JP | 9-260004 | 10/1997 |
| JP | 2005-332644 | 12/2005 |
| JP | 2006-12708 | 1/2006 |

* cited by examiner

ELECTRIC CONNECTOR INCLUDING CONNECTOR TERMINAL WITH BUFFER PORTION

BACKGROUND OF THE INVENTION

1. Field of the Invention

The invention relates to a connector terminal for electrically connecting objects such as printed circuit boards to each other, and further to an electric connector including the connector terminal.

2. Description of the Related Art

There is known an electric connector including a plurality of needle-shaped connector terminals each having contact at opposite ends thereof, a male housing in which the connector terminals are arranged in a line and which is mounted on a first printed circuit board, and a female housing into which the male housing is fit and which is mounted on a second printed circuit board. The connector terminal at the contact formed at one end thereof passes a through-hole formed through the female housing, and is inserted into a through-hole formed through the second printed circuit board, thereby the first and second printed circuit boards are electrically connected to each other.

In an electric connector for electrically connecting two printed circuit boards to each other through connector terminals, it is important that two printed circuit boards keep a designed positional relation. For instance, if a positional relation between two printed circuit boards were deflected from an intended relation, even if a connector terminal could be inserted through a contact thereof into a first printed circuit board, the connector terminal might not be inserted into a second printed circuit board. In particular, when there are employed a plurality of electric connectors, a connector terminal may not be inserted into a second printed circuit board with high possibility.

FIG. 30 is a perspective view of the electric connector suggested in Japanese Patent Application Publication No. H9 (1997)-260004.

The illustrated electric connector includes a housing 61 in which a plurality of terminals 60 are arranged, a first guide 62 for guiding the housing 61 to move in an X-axis direction, and a second guide 63 for guiding the first guide 62 to move in a Y-axis direction. As illustrated in FIG. 30, the terminals 60 downwardly extend through a lower surface of the second guide 63.

FIG. 31 is an enlarged view of the terminal 60.

As illustrated in FIG. 31, the terminal 60 is designed to include a wavy portion 60*a* in a length-wise direction thereof. The wavy portion 60*a* provides sufficient flexibility to the terminal 60. The wavy portion 60*a* is bended to thereby absorb the deflection in a positional relation between the housing 61 and the second guide 63, that is, between opposite ends of the terminal 60.

FIG. 32 is a cross-sectional view of the male connector suggested in Japanese Patent Application Publication No. 2006-12708.

The illustrated male connector 70 is fit into a female connector (not illustrated), and includes a housing 70*a* formed therein with a space 72, and male terminals 13 projecting into the space 72.

The male terminal 73 is designed to have a portion 73*b* thinner than the rest of the male terminal 73. Adjacent to the space 72, there is formed a second space 75. The second space 75 has a size sufficient for the portion 73*b* to be bent. Thus, the portion 73*b* is bent to thereby absorb deflection in a positional relation between upper and lower printed circuit boards, and/or bending of the male connector 73 caused when the male connector 70 is inserted into the female connector.

In the conventional electric connector illustrated in FIG. 30, the wavy portion 60*a* and a male contact formed at a lower end of the terminal 60 are formed integral in a strip-shaped plate. Since the wavy portion 60*a* is curved in a width-wise direction of the strip-shaped plate, the wavy portion 60*a* has a width and a thickness both equal to those of the male contact. Thus, it is considered necessary to exert a tension force on the wavy portion 60*a* in order for the wavy portion 60*a* to be deformed to absorb the positional gap between the housing 61 and the second guide 63.

Accordingly, even if the terminal 60 through which two printed circuit boards are electrically connected to each other were designed to include the wavy portion 60*a*, and were inserted through opposite ends thereof into the two printed circuit boards, the wavy portion 60*a* would be very difficult to be bent, if a positional gap between the housing 61 and the second guide 63 is big, in which case, the terminal 60 would be damaged if the contact formed at a lower end of the terminal 60 is forced to be inserted into a printed circuit board.

In the conventional male connector illustrated in FIG. 32, the portion 73*b* is designed to have a diameter smaller than the same of a contact formed at a top end of the male terminal 73. However, if the portion 73*b* is hammered to thereby have a smaller diameter, a metal density and hence a hardness of the portion 73*b* increases by being hammered, resulting in that the portion 73*b* is difficult to be bent.

SUMMARY OF THE INVENTION

In view of the above-mentioned problems in the conventional connectors, it is an object of the present invention to provide a connector terminal including a buffer portion capable of being readily bent when male and female housings are fit into each other, to thereby absorb a positional gap between the male and female housings. It is further an object of the present invention to provide an electric connector employing therein the above-mentioned connector terminal.

In one aspect of the present invention, there is provided a connector terminal including a first contact at one end, a second contact at the other end, and a buffer portion, the connector terminal electrically connecting a first object connected to the first contact to a second object connected to the second object, the buffer portion being bent in accordance with a positional gap between the first and second objects, the buffer portion being smaller in one of a thickness and a width than the first and second contacts.

In the connector terminal in accordance with the present invention, the buffer portion is smaller in width or thickness than the first and second contacts. Thus, even if the buffer portion were hammered in order to design the buffer portion to be smaller in width or thickness than the first and second contacts, the buffer portion would be hammered only in width-wise or thickness-wise direction thereof, and hence, it would be possible to avoid the buffer portion from being too hard, and further, it would be possible for the buffer portion to be more bendable than the first and second contacts, keeping rigidity of the first and second contacts as it is. Thus, the buffer portion can absorb any positional gap between the first and second objects, even though the positional gap is slight.

It is preferable that the buffer portion is curved in at least one of a width-wise direction and a thickness-wise direction thereof.

The buffer portion designed to be curved in a width-wise direction would be readily bent when the opposite ends of the connector terminal are deflected in a thickness-wise direction, because the buffer portion is thin in a thickness-wise direction, and could be bent in a width-wise direction when the opposite ends of the connector terminal are deflected in a width-wise direction, because a degree of curvature of the buffer portion is made higher at one side and lower at the other side. The buffer portion designed to be curved in a thickness-wise direction would be difficult to be bent when the opposite ends of the connector terminal are deflected in a width-wise direction, but would be readily bent in a thickness-wise direction, because the buffer portion is thin in a thickness-wise direction, and further because a degree of curvature is made higher at one side and lower at the other side.

It is preferable that the buffer portion is spiral in a length-wise direction thereof.

It is preferable that the buffer portion is formed with at least one slit extending in a length-wise direction thereof.

It is preferable that the buffer portion is formed with a plurality of slits extending in a length-wise direction thereof, and the slits being aligned in a width-wise direction of the buffer portion.

It is preferable that the first and second contacts are comprised of at least two layers of a folded plate to be thicker than the buffer portion.

By folding a plate into two layers to design the first and second contacts to be thicker than the buffer portion, the buffer portion can be prevented from being hardened by being pressed.

It is preferable that the buffer portion produced by hammering or punching in a sheet metal stamping thereby thickness of the buffer portion can be smaller than that of the first and second contacts.

By forming the first and second contacts and buffer portion in the above-mentioned manner, the connector terminal including the first and second contacts both of which are relatively thick, and the buffer portion which is relatively thin can be readily fabricated.

In another aspect of the present invention, there is provided an electric connector including the above-mentioned connector terminal, a housing mounted on the first object, the housing being formed with a through-hole into which the first contact is inserted, and a guide for introducing the first contact to the through-hole when the first contact is inserted into the through-hole.

In accordance with the above-mentioned electric connector, even if the opposite ends of the connector terminal were deflected, the guide introduces the first contact to the through-hole with the buffer portion being bent, ensuring that the first contact can be surely inserted into the through-hole.

It is preferable that the guide includes a hole leading to the through-hole, and a slope downwardly inclining in a direction in which the first contact is inserted into the through-hole, and making contact at a lower end thereof with an upper end of the hole.

By designing the guide to include the above-defined slope, when the first contact is to be inserted into a through-hole, the first contact is guided with a distal end thereof being sliding on the slope.

It is preferable that a plurality of the connector terminals is arranged in a line, the electric connector includes a plurality of the guides in accordance with the plurality of the connector terminals, and each of the guides has a rectangular entrance opening, the guides being arranged in a line such that an entrance opening of a first guide is located close to an entrance opening of a second guide disposed adjacent to the first guide.

It is possible to arrange the guides without a space, ensuring that the connector terminals can be arranged at a small pitch.

The advantages obtained by the aforementioned present invention will be described herein below.

In the connector terminal in accordance with the present invention, since the buffer portion is designed to be thinner in a width-wise or thickness-wise direction than the first and second contacts, the buffer portion can be bent more readily than the first and second contacts when the connector terminal is inserted into a housing, ensuring the buffer portion can absorb the deflection between opposite ends thereof.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

The electric connector in accordance with the first embodiment of the present invention will be explained hereinbelow with reference to the drawings.

Figure 1:
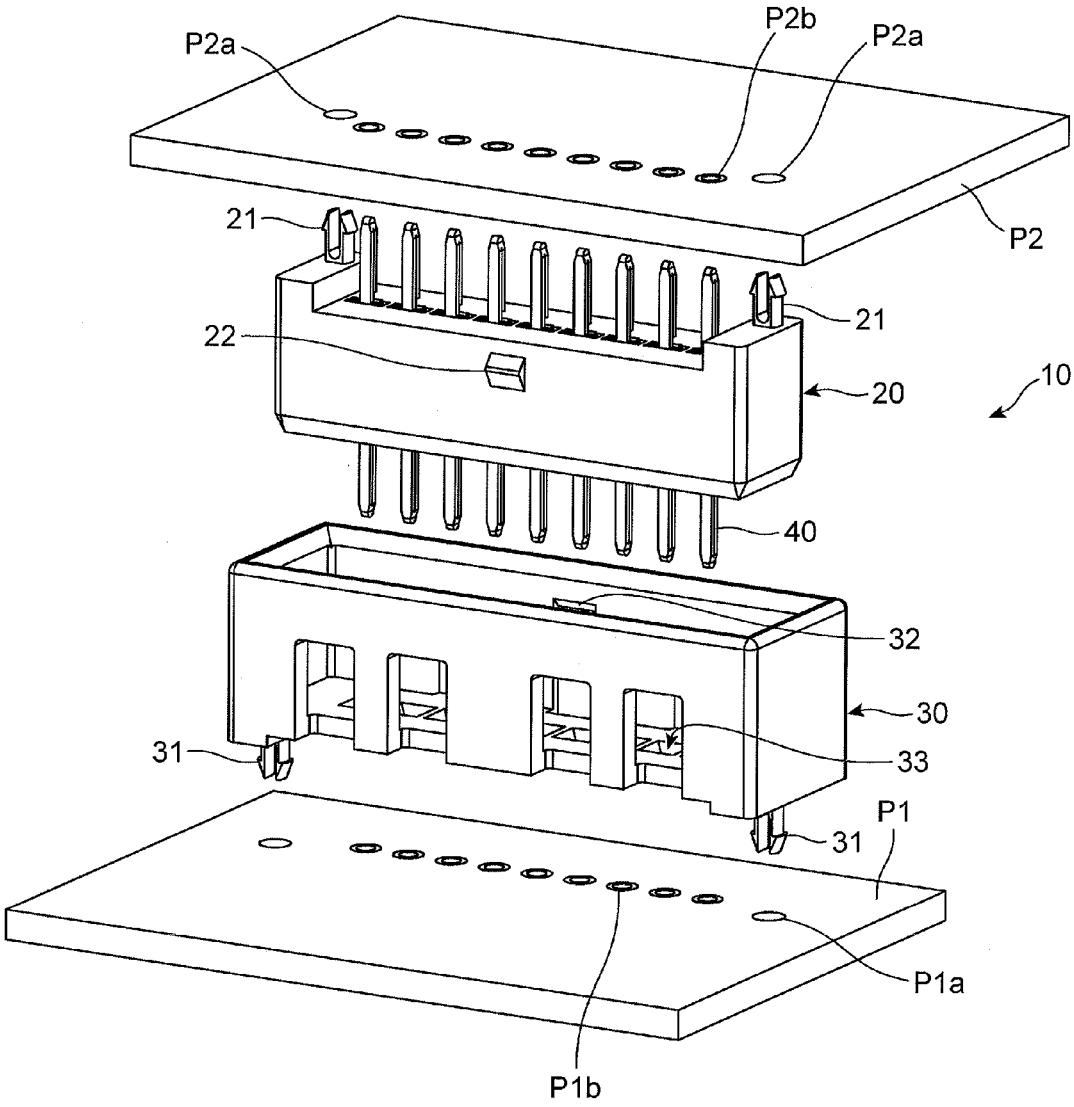
FIG. 1 is an exploded perspective view of the electric connector in accordance with the first embodiment of the present invention, including a male housing in which connector terminals are housed, and a female housing into which the male housing is fit.
Figure 2:
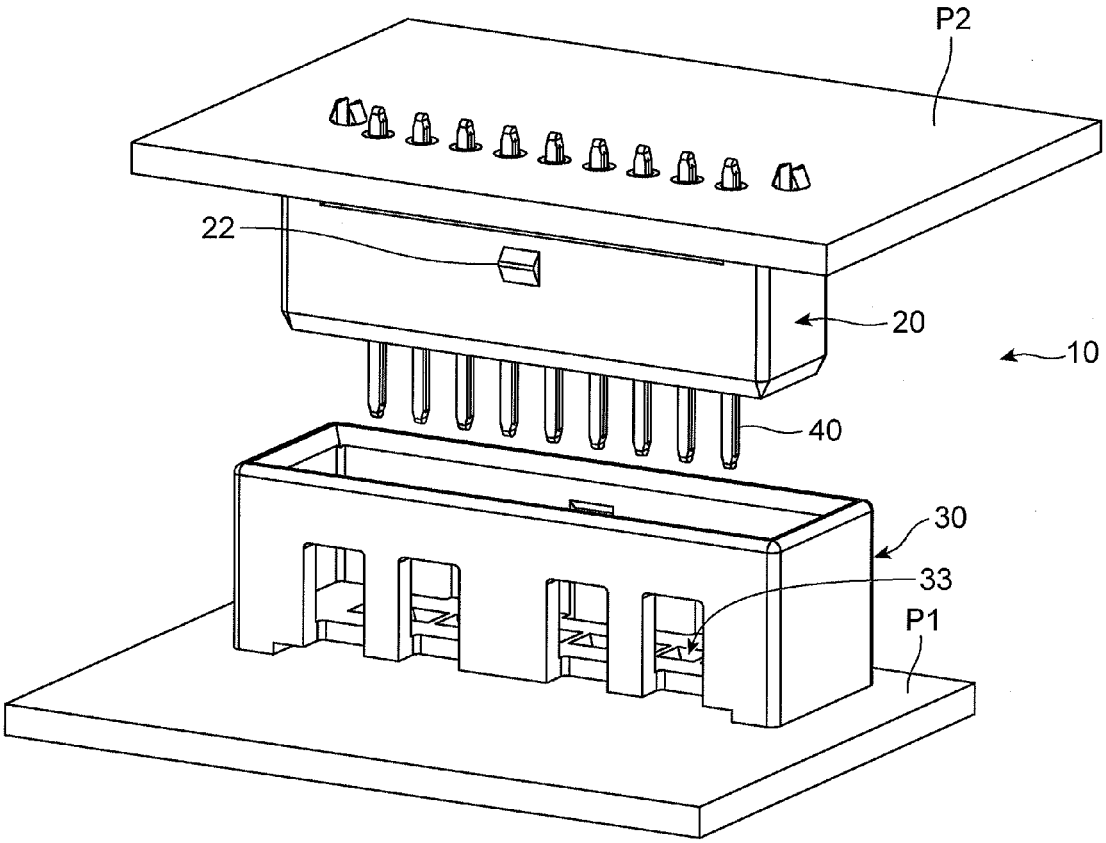
FIG. 2 is a perspective view of the male and female housings of the electric connector illustrated in FIG. 1, showing a condition before the male and female housings are fit into each other.

As illustrated in FIGS. 1 and 2, the electric connector 10 in accordance with the first embodiment may be used to electrically connect printed circuit boards equipped in an automobile to each other, for instance. The electric connector 10 electrically connects a printed circuit board P1 as an example of a first object to a printed circuit board P2 as an example of a second object.

The electric connector 10 includes a male housing 20 mounted on the printed circuit board P2, a female housing 30 mounted on the printed circuit board P1 and fit to the male housing 20, a plurality of connector terminals 40 arranged in a line in the male housing 20.

The male housing 20 is designed to be almost a rectangular parallelepiped. The male housing 20 is formed at opposite ends at a bottom with a pair of bosses 21 inserted into through-holes P2*a* of the printed circuit board P2, and further formed at a front and a rear with engagement projections 22 making engagement with recesses 32 formed at an inner wall of the female housing 30. The male housing 20 is formed therein with a plurality of terminal storage rooms 23 (see FIG. 9) in which the connector terminals 40 are housed with opposite ends thereof being projected beyond the male housing 20. The terminal storage rooms 23 are arranged in a line in a length-wise direction of the male housing 20, and are designed to align with the through-holes P2*a* formed through the printed circuit board P2.

The female housing 30 is substantially in the form of a box and has a rectangular opening at a top. An inner space of the female housing 30 defines a space into which the male housing 20 is inserted. The female housing 30 is formed at opposite ends at a bottom with a pair of bosses 31 inserted into through-holes P1*a* of the printed circuit board P1. The female housing 30 is formed at front and rear inner walls thereof with recesses 32 with which the engagement projections 22 of the male housing 20 make engagement.

Since the engagement between the engagement projection 22 and the recesses 32 is designed to be a fitting with play (so-called free fit), the male housing 20 and the female housing 30 are able to slightly move relative to each other.

Figure 3:
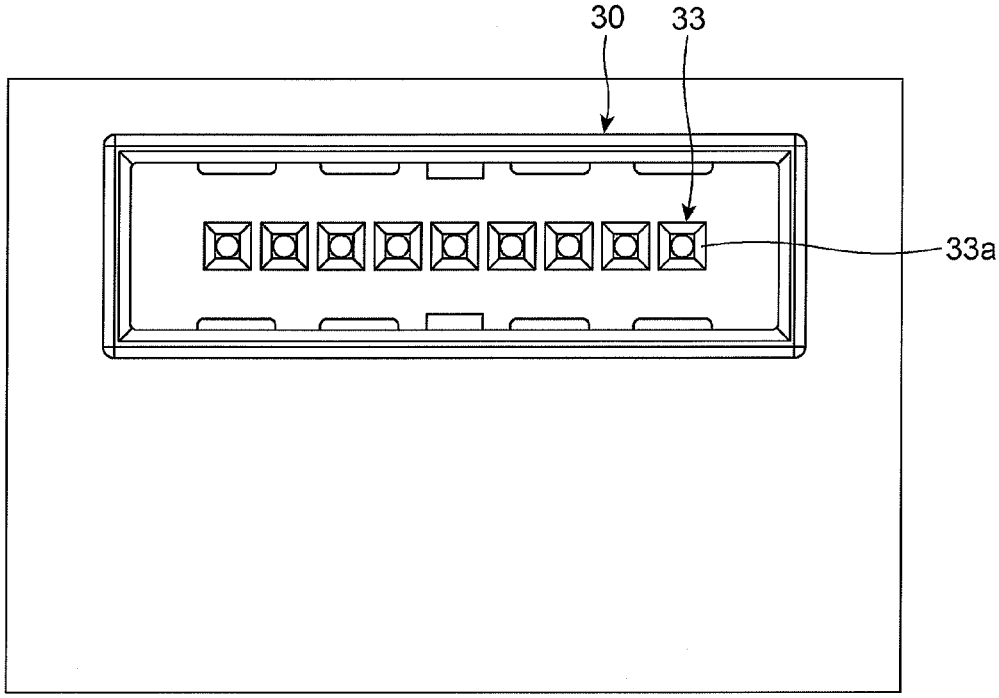
FIG. 3 is a plan view of the female connector of the electric connector illustrated in FIG. 1.

As illustrated in FIGS. 1 and 3, the male housing 30 is formed at a bottom with a plurality of guides 33 each defining a through-hole through which the connector terminal 40 is inserted. The guides 33 are aligned in accordance with both the arrangement of the connector terminals 40 and the arrangement of the through-holes P1*b* of the printed circuit board P1.

Figure 9:
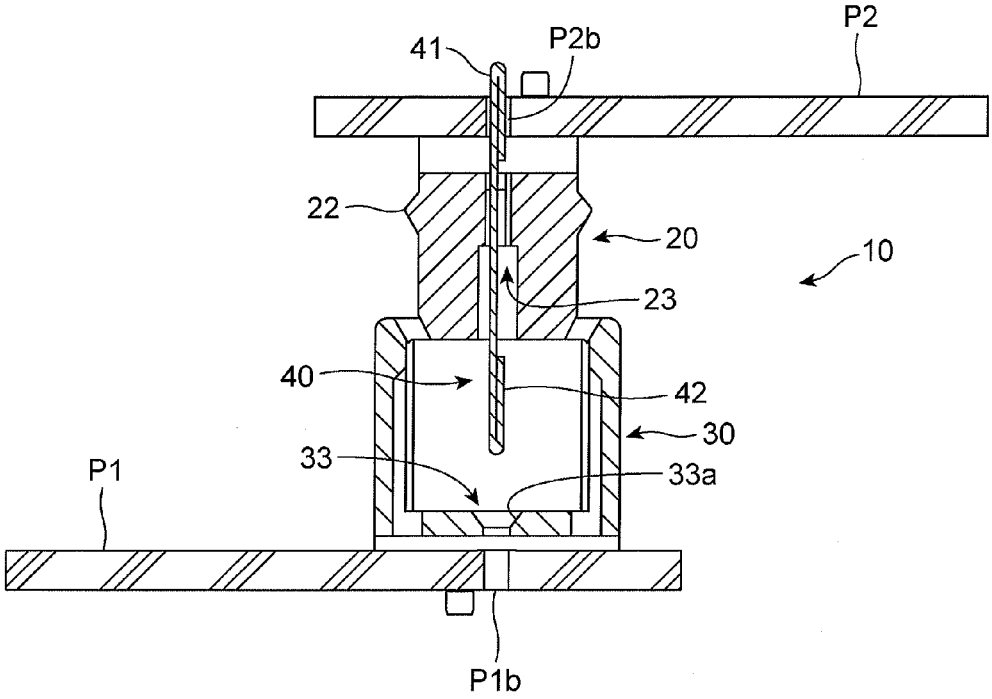
FIG. 9 is a cross-sectional view taken along the line A-A shown in FIG. 7.

As illustrated in FIGS. 3 and 9, each of the guides 33 is designed to have a hole leading to the through-hole P1*b*, and a slope 33*a* connecting at a lower end thereof with an upper end of the hole. Each of the guides 33 has a rectangular entrance opening having a contour broader than the same of the through-hole P1*b*, and a rectangular exit opening having a size almost equal to a size of the through-hole P1*b*. As illustrated in FIG. 9, the slope 33*a* downwardly inclines from the entrance opening towards the exit opening, that is, inclines in a direction in which the connector terminal 40 is inserted into the through-hole P1*b*.

Figure 4A:
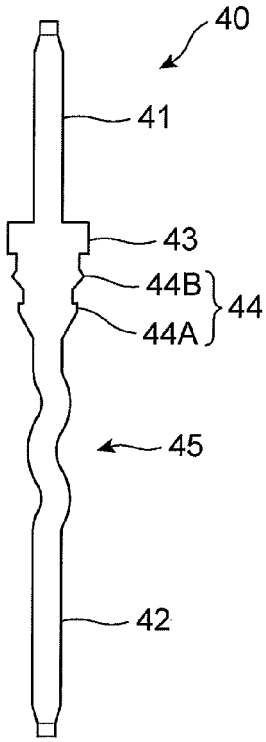
FIG. 4A is a front view of the connector terminal used in the electric connector illustrated in FIG. 1.
Figure 4B:
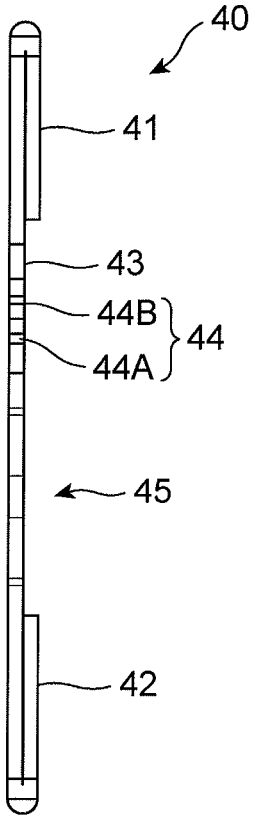
FIG. 4B is a side view of the connector terminal used in the electric connector illustrated in FIG. 1.
Figure 5:
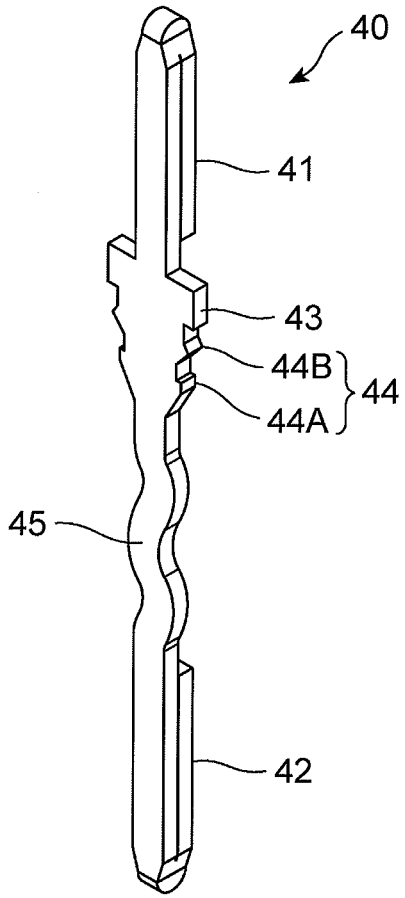
FIG. 5 is a perspective view of the connector terminal illustrated in FIGS. 4A and 4B.

The connector terminal 40 illustrated in FIGS. 4A, 4B and 5 is a male connector terminal designed to have at one end thereof a first contact 42 to be inserted into and soldered in the through-hole P1*b*, and at the other end thereof a second contact 21 to be inserted into and soldered in the through-hole P2*b*. The first and second contact 42 and 41 are formed by folding a strip-shaped plate into two layers about bending lines 46 and 47 perpendicular to an axis of the plate. The connector terminal 40 is formed in the vicinity of the second contact 41 with a pair of shoulders 43 at which the connector terminal 40 is pushed into the terminal storage room 23. Adjacent to the shoulders 43, the connector terminal 40 is formed with an engagement portion 44 making engagement with an inner wall of the terminal storage room 23 when the connector terminal 40 is inserted into the terminal storage room 23. The engagement portion 44 includes a pair of first projections 44A, and a pair of second projections 44B located closer to the shoulders 43 than the first projections 44A and having a height greater than the same of the first projections 44A.

The connector terminal 40 includes, between the first and second contacts 41 and 42, and the engagement portion 44, a buffer portion 45 bendable in accordance with deflection of an axis of the connector terminal 40. The buffer portion 45 is designed to have a width equal to the same of the first and second contacts 42 and 41. Since the first and second contacts 42 and 41 are formed by folding a strip-shaped plate into two layers, the buffer portion 45 has a thickness equal to a half of a thickness of the first and second contacts 42 and 41. The buffer portion 45 is designed to be wavy by alternately being curved in opposite width-wise directions.

Figure 6A:
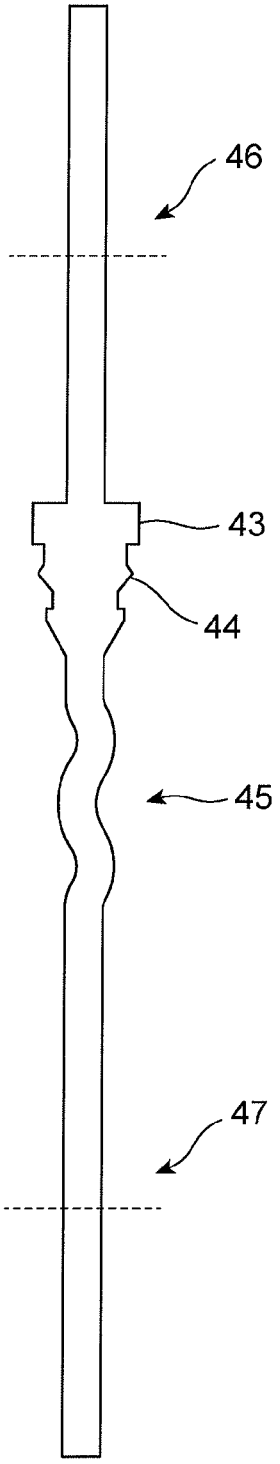
FIG. 6A is a front view of a metal plate from which the connector terminal illustrated in FIGS. 4A and 4B is fabricated.
Figure 6B:
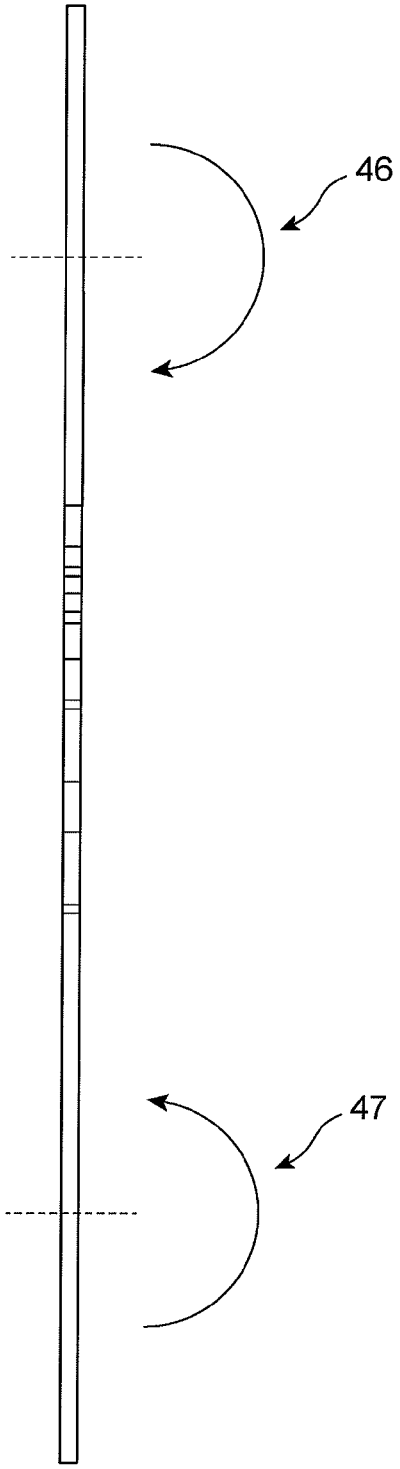
FIG. 6B is a side view of a metal plate from which the connector terminal illustrated in FIGS. 4A and 4B is fabricated.

The connector terminal 40 is formed by punching a metal plate to have such a contour as illustrated in FIGS. 6A and 6B, folding the plate about lines 46 and 47 (shown with a broken line in FIGS. 6A and 6B) into two layers one on another, and grinding the folded plate at corners of opposite ends to be sharp to thereby form the first and second contacts 42 and 41. Thus, the connector terminal 40 including the first and second contacts 42 and 41 both thicker than the buffer portion 45 can be readily fabricated of a single plate by punching a thin metal plate, and bending the plate about the bending lines 46 and 47.

The electric connector 10 in accordance with the first embodiment of the present invention, having the above-mentioned structure, is used as follows.

Figure 7:
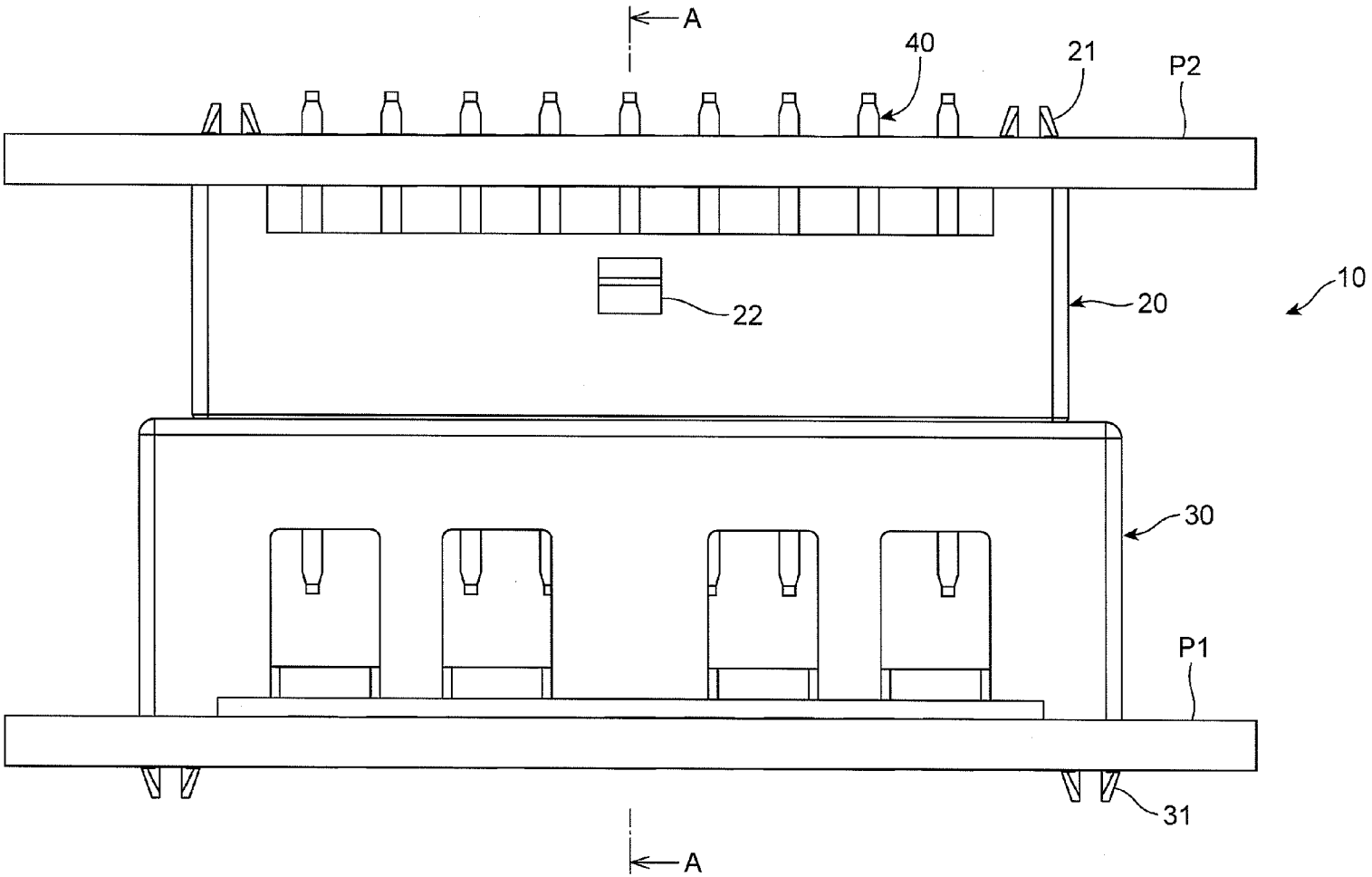
FIG. 7 is a front view of the male and female housings of the electric connector illustrated in FIG. 2, showing a condition when the male and female housings approach each other.
Figure 8:
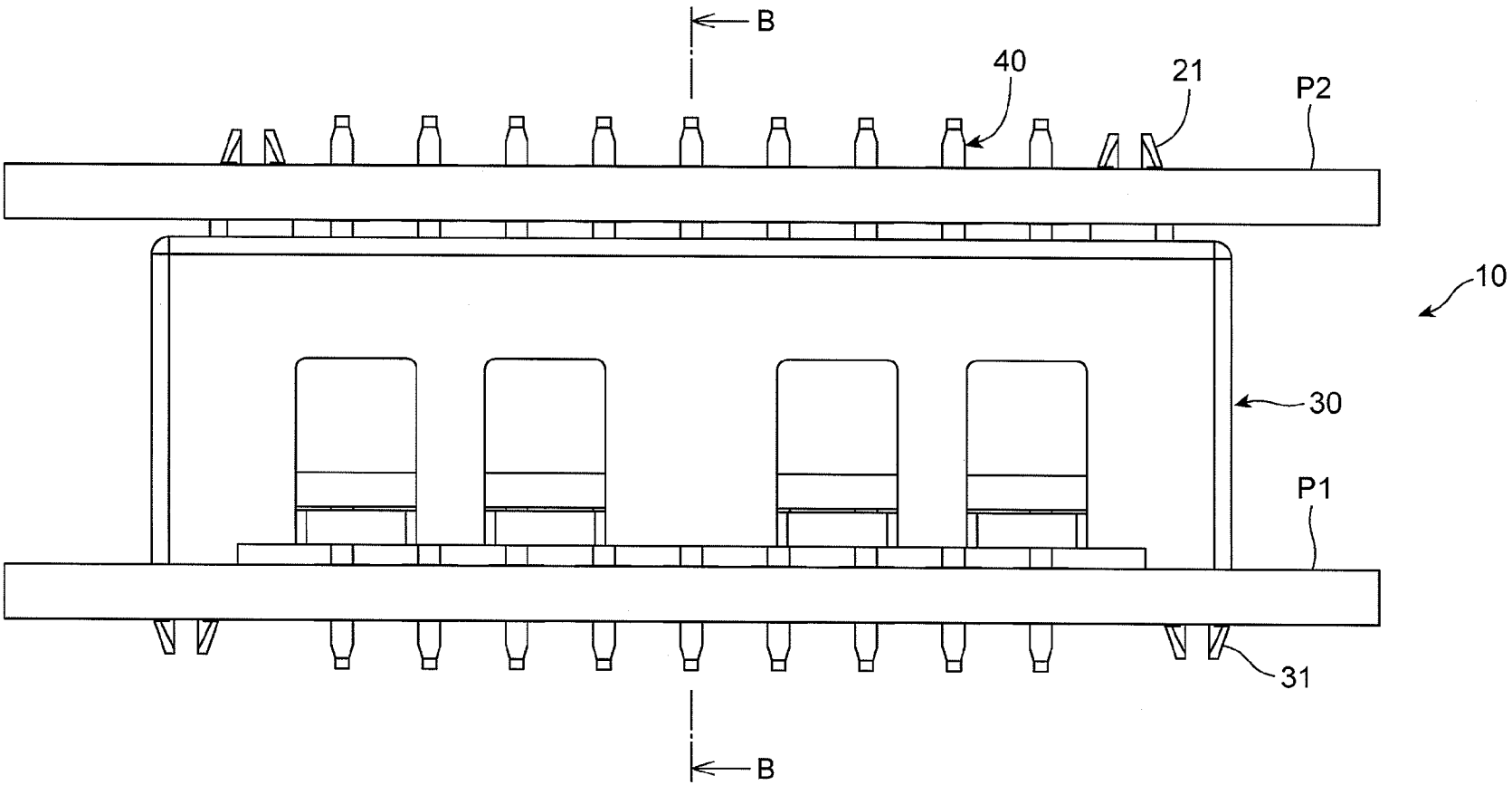
FIG. 8 is a front view of the male and female housings of the electric connector illustrated in FIG. 2, showing a condition when the male and female housings are fit into each other.

As illustrated in FIGS. 7 and 9, the male housing 20 mounted on the printed circuit board P2 is aligned with the female housing 30 mounted on the printed circuit board P1, and the first contact 42 of the connector terminal 40 is aligned with the guide 33 of the female housing 30. Then, the male housing 20 is inserted into and fit in the female housing 30.

Figure 10:
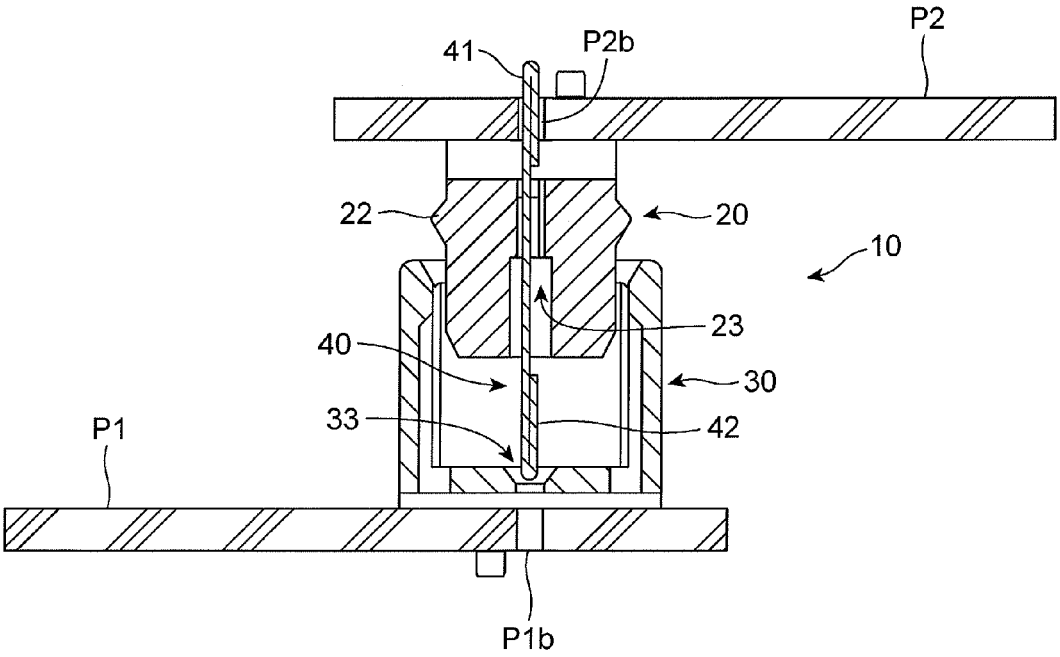
FIG. 10 is a cross-sectional view of the electric connector illustrated in FIG. 9, showing a condition that the connector terminal is inserted into a housing without deflection in a positional relation between upper and lower printed circuit boards.

If the printed circuit boards P1 and P2 were in a designed positional relation, as illustrated in FIG. 10, the first contact 42 passes through the guide 33 at a center of the guide 33, and is inserted into the through-hole P1*b* of the printed circuit board P1.

Figure 11:
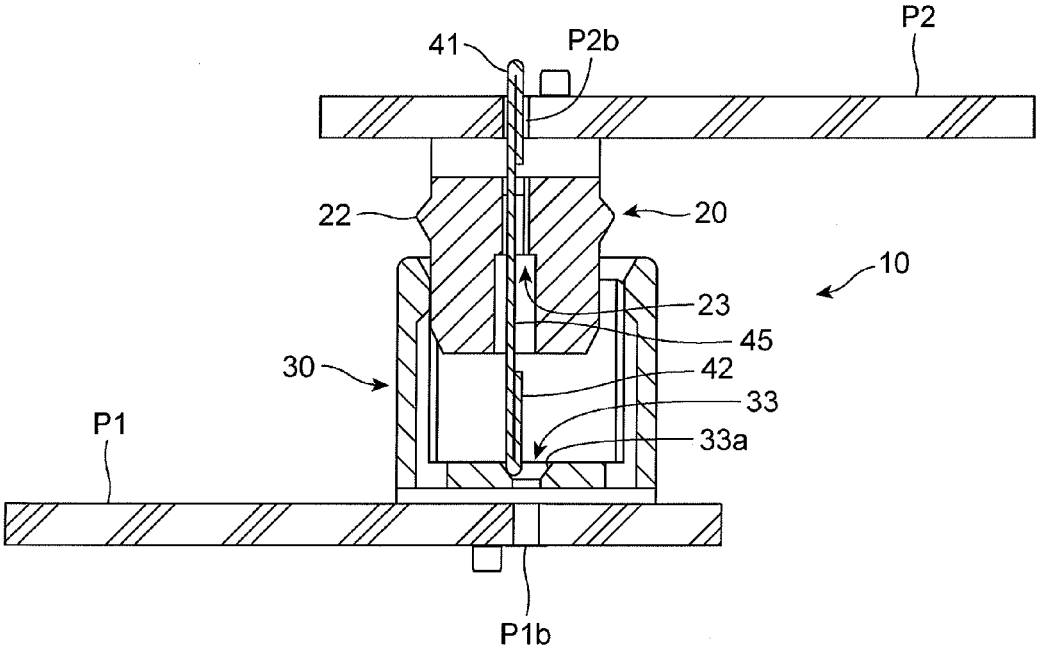
FIG. 11 is a cross-sectional view of the electric connector illustrated in FIG. 9, showing a condition that the connector terminal is inserted into a housing with deflection in a positional relation between upper and lower printed circuit boards.
Figure 12:
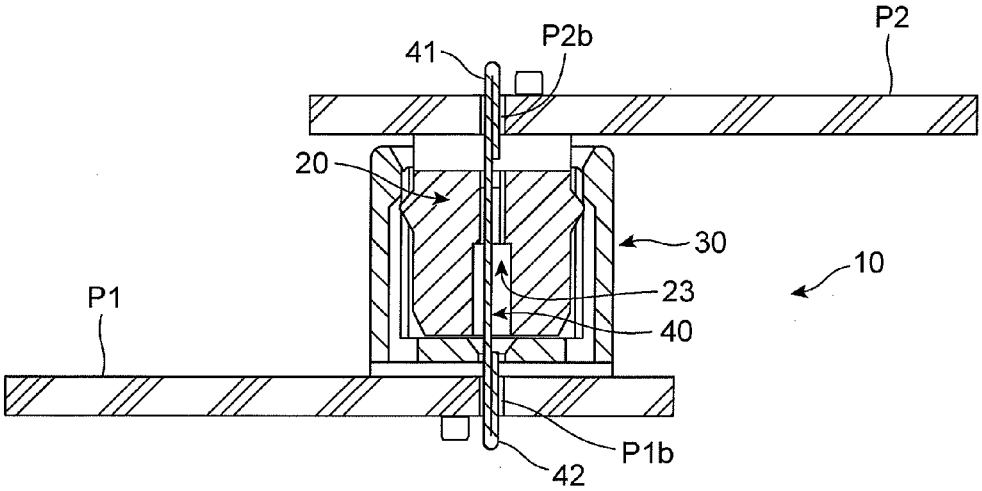
FIG. 12 is a cross-sectional view taken along the line B-B shown in FIG. 8.

As illustrated in FIG. 11, even if a positional relation between the printed circuit boards P1 and P2 were deflected, and thereby a positional relation between the male housing 20 and the female housing 30 were deflected, the first contact 42 makes abutment at a distal end thereof with the slope 33*a* of the guide 33, and is introduced to the exit opening, sliding on an inclined surface of the slope 33*a*. When the first contact 42 is introduced to the exit opening of the guide 33, an axis of the connector terminal 40 is curved, however, since the connector terminal 40 includes the buffer portion 45 bendable in accordance with curvature of the axis, the buffer portion 45 is bent, and hence, the first contact 42 is introduced to the through-hole P1*b* through the guide 33, and is inserted into the through-hole P1*b* without the connector terminal 40 being buckled.

For instance, when the first and second contacts 42 and 41 are deflected in a thickness-wise direction, the buffer portion 45 composed of a thin plate is bent in a thickness-wise direction, and the first contact 42 is guided by the guide 33 and inserted into the through-hole P1*b*.

When the first and second contacts 42 and 41 were deflected in a width-wise direction, a curvature of the buffer portion being wavy in a width-wise direction is made higher at one side and lower at the other side. Thus, the first contact 42 is introduced by the guide 33 to thereby be inserted into the through-hole P1*b* with the connector terminal 40 being bent in a width-wise direction.

As mentioned above, it is possible to cause the first contact 42 to pass through the guide 33 with less resistance, and to be surely inserted into the through-hole P1*b* of the printed circuit board P1.

The buffer portion 45 is designed to have a thickness equal to a half of a thickness of the first and second contacts 42 and 41, and a width almost equal to the same of the first and second contacts 42 and 41. Accordingly, the buffer portion 45 is able to have strength in a width-wise direction, and to be more bendable than the first and second contacts 42 and 41 in a thickness-wise direction. Furthermore, since the first and second contacts 42 and 41 are formed by folding a plate into two layers, the buffer portion 45 is thinner than the first and second contacts 42 and 41, and further, since the buffer portion 45 is not formed by compressing a metal plate, the buffer portion 45 is prevented from being hardened. Thus, the first and second contacts 42 and 41 can keep a requisite rigidity, and the buffer portion 45 can absorb the deflection of an axis of the connector terminal 40 by being bent, even if the deflection were slight.

In addition, since the guide 33 is designed to be rectangular, and the guides 33 are arranged in a line, the guides 33 can be arranged without a space between adjacent guides. Since a rectangular entrance opening can be greater in an area than a circular entrance opening, if the connector terminals 40 are arranged at a constant pitch, it is possible to align the connector terminals 40 at a smaller pitch, and further, the first contact 42 can be readily introduced into the through-hole P1*b*.

In the above explanation, the deflection in a positional relation between the printed circuit boards P1 and P2, caused when the connector terminal 40 is inserted into the through-hole P1*b* through the female housing 30, is mentioned. In the case that the electric connector 10 is equipped in an automobile, after the male housing 20 and the female housing 30 were fit into each other and the first contact 42 was soldered to the printed circuit board P1, the deflection in a positional relation between the male housing 20 and the female housing 30 may be caused due to oscillation and/or thermal expansion of the printed circuit boards P1 and P2 caused by temperature fluctuation therearound.

In such a case, the buffer portion 45 is bent in the terminal storage room 23 to absorb the deflection in an axis between the first and second contacts 42 and 41, and hence, even if the deflection in a positional relation between the printed circuit boards P1 and P2 were caused due to oscillation and/or thermal expansion, it is possible to avoid a problem that a load exerts on the first and second contacts 42 and 41, and hence, the solder peels off.

Though the buffer portion 45 in the first embodiment is designed to have a width equal to the same of the first and second contacts 42 and 41, the buffer portion 45 is readily bendable in a thickness-wise direction, because the buffer portion 45 is thinner than the first and second contacts 42 and 41, and the buffer portion 45 is readily bendable in a width-wise direction, because the buffer portion 45 is wavy in a width-wise direction.

Second Embodiment

Figure 13:
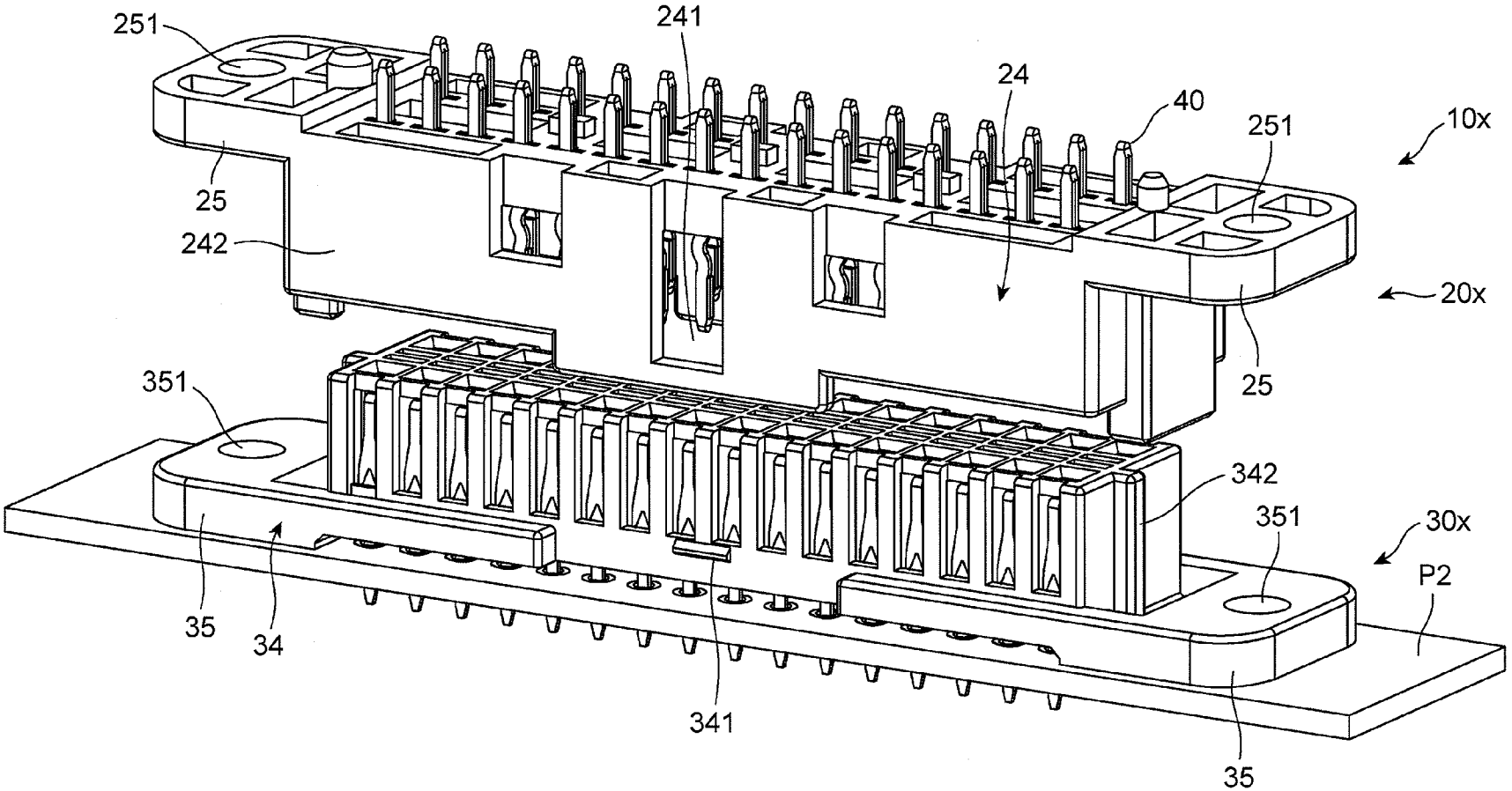
FIG. 13 is a perspective view of the electric connector in accordance with the second embodiment of the present invention, including connector terminals, a male housing in which the connector terminals are housed, a female housing into which the male housing is fit, and female connector terminals housed in the female housing.
Figure 14:
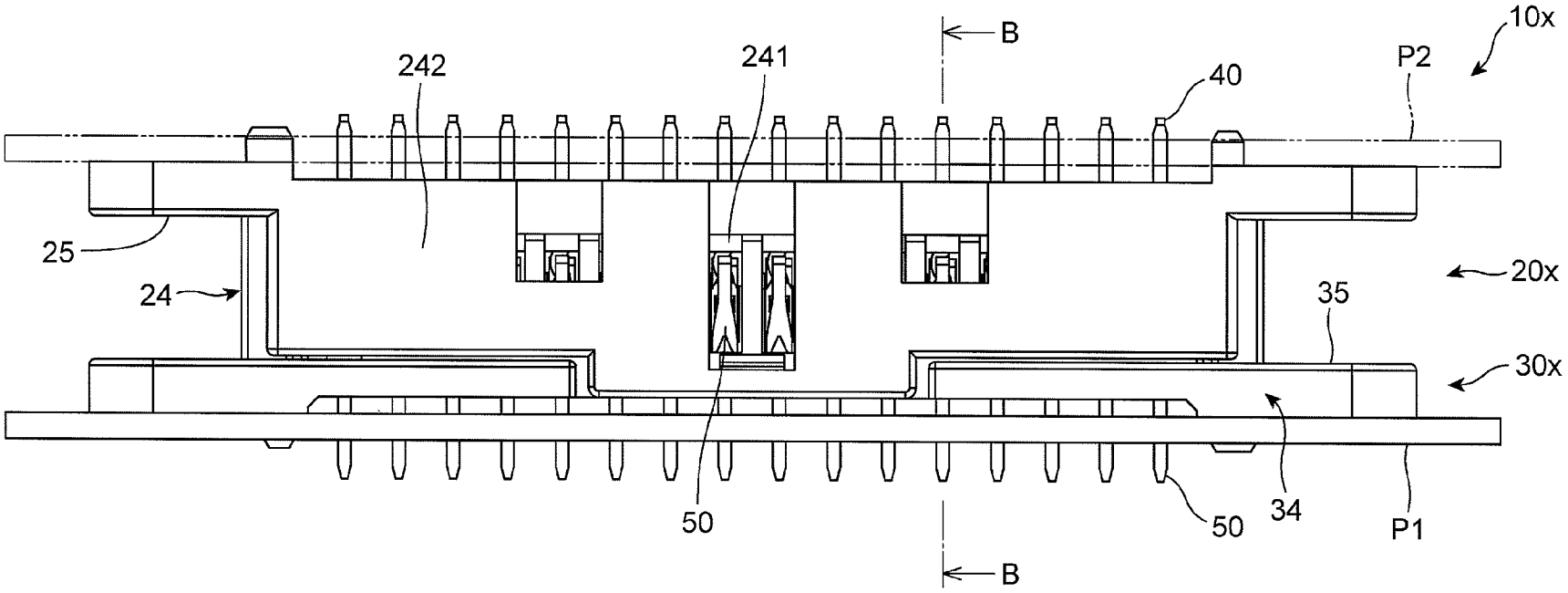
FIG. 14 is a front view of the male and female housing fit into each other of the electric connector illustrated in FIG. 13.
Figure 15:
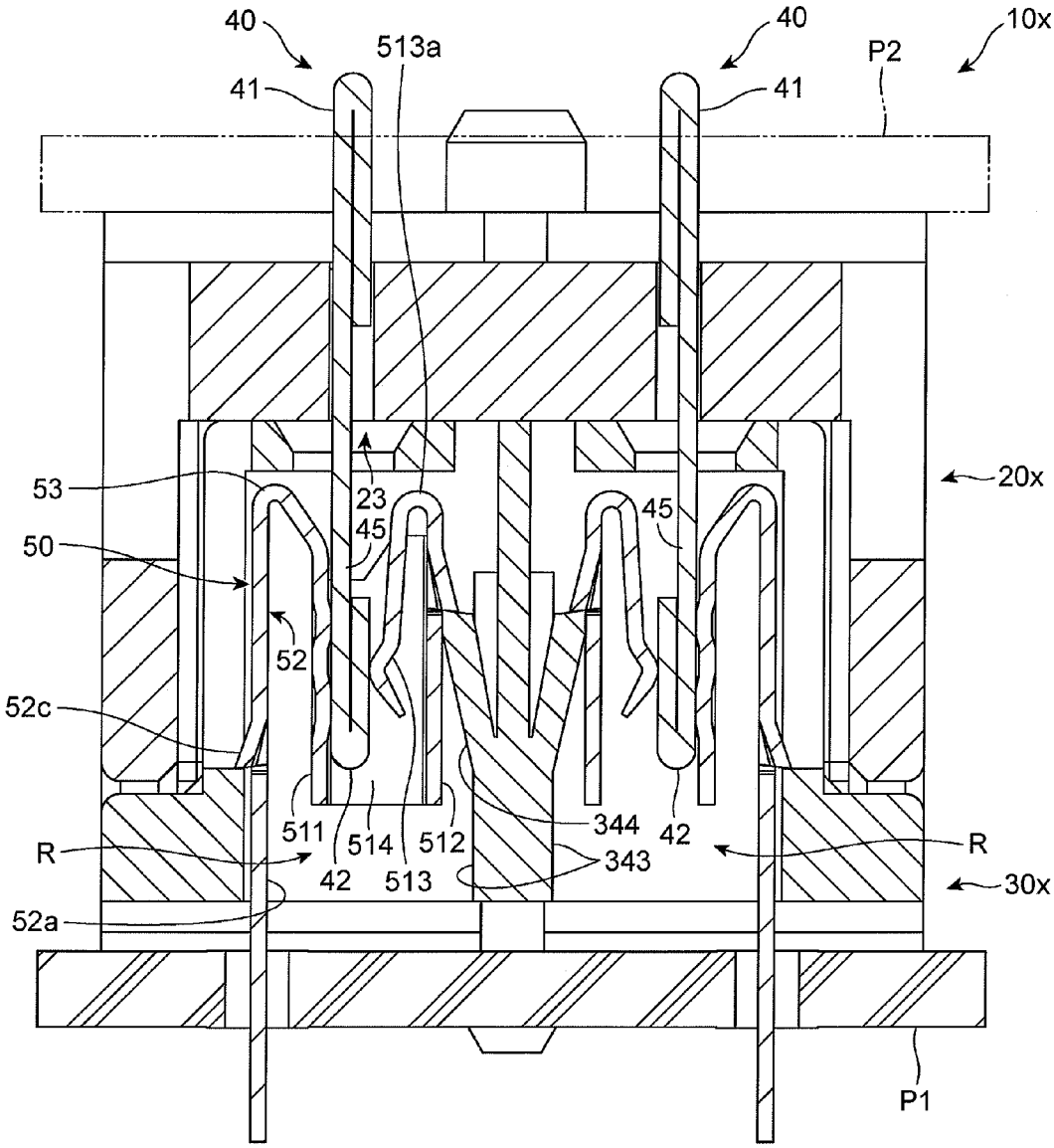
FIG. 15 is a cross-sectional view taken along the line B-B shown in FIG. 14.

The electric connector in accordance with the second embodiment of the present invention is explained hereinbelow with reference to the drawings. The female housing 30*x* in the electric connector 10*x* in accordance with the second embodiment is designed to include a plurality of female connector terminals into which the connector terminals 40 are inserted. In FIGS. 13 to 15, parts or elements that correspond to those of the electric connector illustrated in FIG. 1 have been provided with the same reference numerals, and will not be explained.

The electric connector 10*x* in accordance with the second embodiment, illustrated in FIGS. 13 and 14, includes a male housing 20*x* mounted on a printed circuit board (not illustrated) as a first object, a plurality of connector terminals 40 housed in the male housing 20*x*, a female housing 30*x* mounted on the printed circuit board P2 as a second object, and a plurality of female connector terminals 50 housed in the female housing 30*x*.

The male housing 20*x* is in the form of a box having a bottom, and is open at a side opposite to the bottom. The male housing 20*x* include a housing main body 24 in which the connector terminals 40 are fixedly arranged in a matrix, and a pair of flanges 25 outwardly extending in a length-wise direction of the housing main body 24 from opposite ends of the housing main body 24.

The housing main body 24 is formed by peripheral wall 242 with openings 241 and recesses (not illustrated) making engagement with projections 341 and convexes 342 of the female housing 30*x*. Since the engagement between the projections 341 and the openings 241 and the engagement between the convexes 342 and the recesses are designed to be a fitting with play (so-called free fit), the male housing 20*x* and the female housing 30*x* are able to slightly move relative to each other. The flanges 25 are formed with through-holes 251 through which the male housing 20*x* is fixed to a printed circuit board by means of a fixing unit.

The female housing 30*x* is designed to be almost rectangular, when viewed vertically. The female housing 30*x* include a housing main body 34 in which terminal storage rooms R in which the female connector terminals 50 are housed and arranged in a matrix, and a pair of flanges 35 outwardly extending in a length-wise direction of the housing main body 34 from opposite ends of the housing main body 34.

As illustrated in FIG. 15, a pair of lance portions 344 obliquely extends from opposite surfaces of a partition wall 343, that is, an inner wall for partitioning two rows of the terminal storage rooms R arranged in a length-wise direction of the housing main body 34.

As illustrated in FIGS. 13 and 14, the flanges 35 are formed with through-holes 351 through which the female housing 30*x* is fixed to the printed circuit board P2 by means of a fixing unit.

Figure 16:
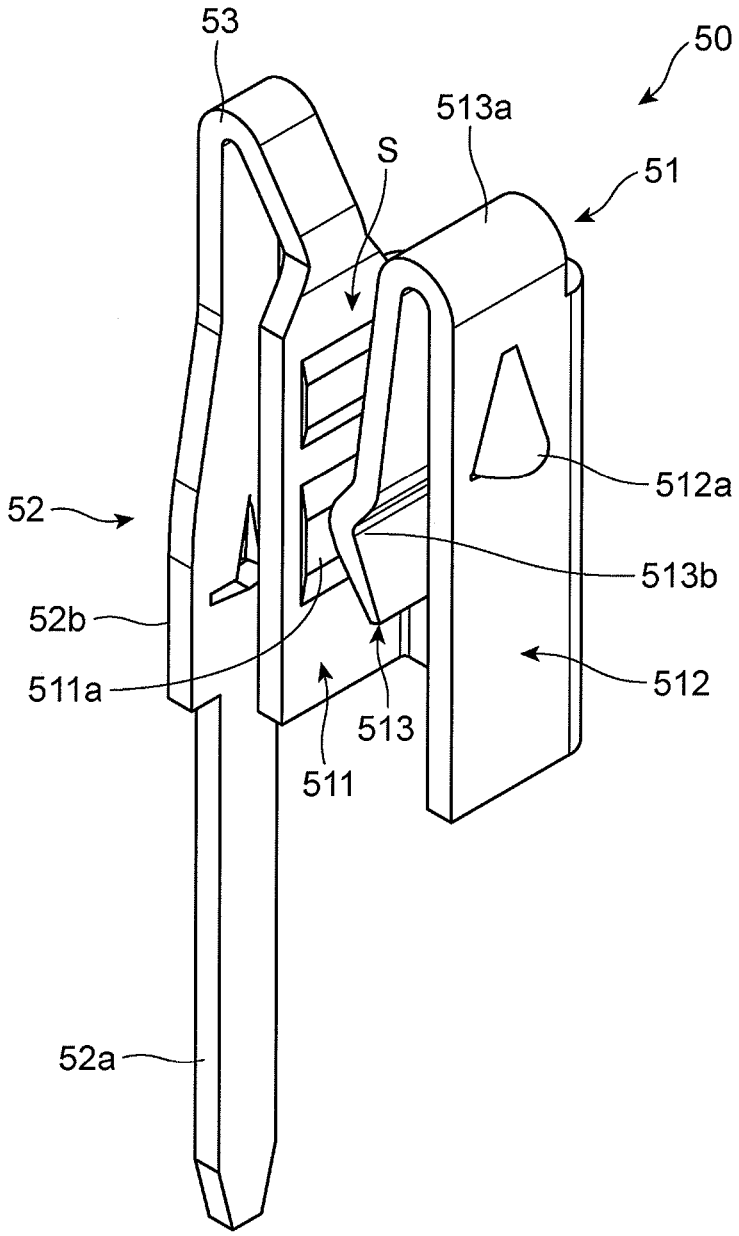
FIG. 16 is a perspective view of the female connector terminal illustrated in FIG. 13, viewed in a direction of the spring support portion.
Figure 17:
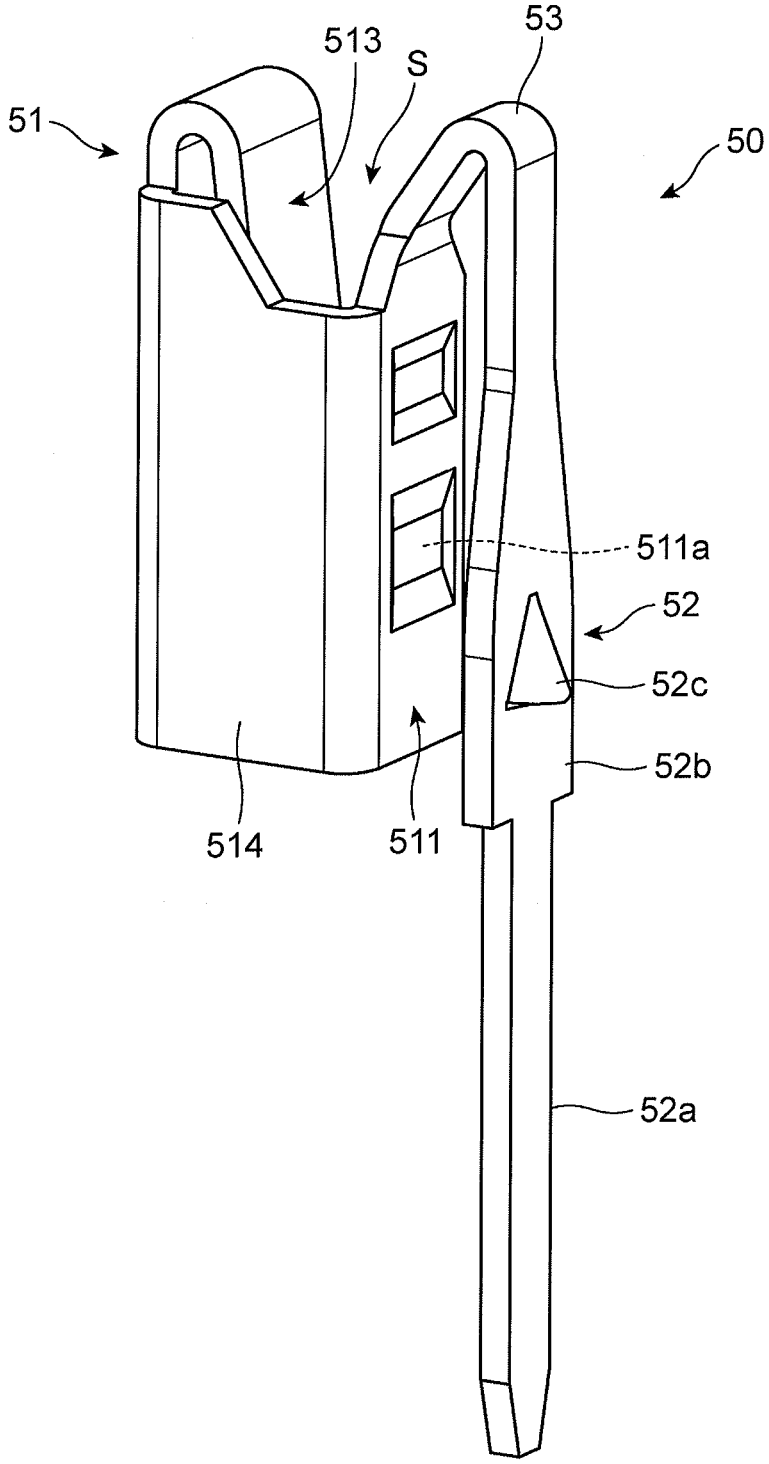
FIG. 17 is a perspective view of the female connector terminal illustrated in FIG. 13, viewed in a direction of the connector.

The female connector terminal 50 illustrated in FIGS. 16 and 17 is housed in the terminal storage room R of the female housing 30*x*, and includes a terminal main body 51 connected to a support leg portion 52 through a resilient portion 53. The female connector terminal 50 is formed by punching a metal plate, and bending the plate. The female connector terminal 50 is housed in the terminal storage room R such that the first contact 42 is inserted into a thickness-wise direction of the connector terminal 40 (see FIG. 15).

The terminal main body 51 includes a contact portion 511, a spring support portion 512, a spring portion 513, and a connector 514.

The contact portion 511 comprises a terminal making contact with one side of a male connector terminal, that is, the connector terminal 40. The contact portion 511 is formed at a contact surface thereof with two substantially rectangular projections 511*a*. The projections 511*a* are formed by beading.

The spring support portion 512 supports the spring portion 513. The spring support portion 512 is formed at a rear surface (opposite side relative to the spring portion 513) with a substantially triangular projection 512*a* making engagement with the lance portion 344 of the female housing 30*x*. The projection 512*a* is formed by pressing, including a step of cutting a bottom of the triangle.

The spring portion 513 is disposed facing the contact portion 511 such that there is formed a space S between the spring portion 513 and the contact portion 511, into which the connector terminal 40 of the male electric connector 100 is inserted. The spring portion 513 is designed to have a width almost equal to the same of the spring support portion 512, and downwardly extends from a top end of the spring support portion 512 through a bending portion 513*a* to thereby make contact with the other side of the connector terminal 40. The spring portion 513 has a structure of a flat spring. The spring 513 is formed at a distal end thereof with a contact 513*b* formed by bending the metal plate substantially V-shaped.

The connector 514 acts as a space-limiter restricting a space between the contact portion 511 and the spring support portion 512, that is, preventing the contact portion 511 and the spring support portion 512 from separating away from each other. The connector 514 connects a side of the contact portion 511 to a side of the spring support portion 512, wherein the sides extend in a direction in which the connector terminal 40 is inserted into and pulled out of the space S.

The support leg 52 has one end 52*a* inserted into the printed circuit board P1 to thereby fix the support leg 52 on the printed circuit board P1, and the other end connected to the resilient portion 53. The support leg 52 is formed with a width-increased portion 52*b* at which the connector terminal 50 is pushed into the terminal storage room R of the female housing 30*x*. The support leg 52 is formed further with a substantially triangular projection 52*c* making engagement with a projection formed with the female housing 30*x*. The projection 52*c* is formed by pressing, including a step of cutting a bottom of the triangle.

The resilient portion 53 is designed to have a width smaller than the same of the width-increased portion 52*b* of the support leg 52 in order to be readily and resiliently bendable. The resilient portion 53 comprises a substantially U-shaped flat spring disposed between a distal end of the support leg 52 and a proximal or top end of the contact portion 511.

The electric connector 10*x* in accordance with the second embodiment of the present invention, having the above-mentioned structure, is used as follows.

As illustrated in FIG. 15, the connector terminal 40 of the male housing 20*x* is inserted through the first contact 42 into the insertion space S formed in the female connector terminal 50 housed in the female housing 30*x*.

Being inserted into the insertion space S of the female connector terminal 50, the connector terminal 40 makes contact at one side with the contact portion 511 and at the other side with the spring portion 513 by virtue of a compression force derived from a resilient reaction force of the spring portion 513. Thus, the connector terminal 40 is sandwiched between the contact portion 511 and the spring portion 513.

Herein, it is supposed that the connector terminal 40 is inserted into the female connector terminal 50 with a positional relation between the printed circuit boards P1 and P2 being deflected, or that after the male connector terminal 40 has been inserted into the female connector terminal 50, a positional relation between the printed circuit boards P1 and P2 is deflected by vibration and hence, the connector terminal 40 being inserted into the female connector terminal 50 trembles in the female connector terminal 50.

However, since the contact portion 511 and the spring support portion 512 are connected to each other through the joint portion 514, the terminal main body 51 trembles as its entirety and follows the deflection between the printed circuit boards P1 and P2, maintaining a contact pressure which the contact portion 511 and the spring portion 513 exerts on the connector terminal 40.

Consequently, when a positional relation between the printed circuit boards P1 and P2 is deflected in a thickness-wise direction of the connector terminal 40 (a left-right direction in FIG. 15), the connector terminal 40 can be inserted into the female connector terminal 50, or the connector terminal 40 can be kept inserted in the female connector terminal 50 without the bending of the buffer portion 45 or with slight bending of the buffer portion 45.

(First Variant of the Connector Terminal)

A connector terminal in accordance with the first variant of the connector terminal 40 is explained hereinbelow with reference to the drawings.

Figure 18A:
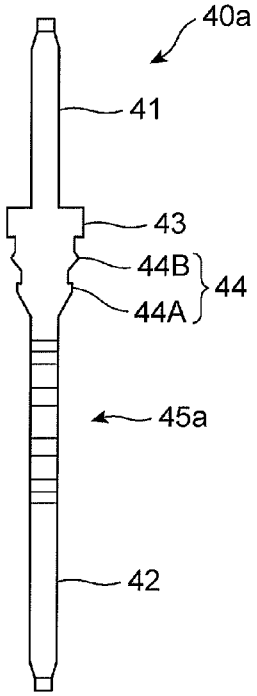
FIG. 18A is a front view of the connector terminal in accordance with the first variant of the connector terminal illustrated in FIG. 4.
Figure 18B:
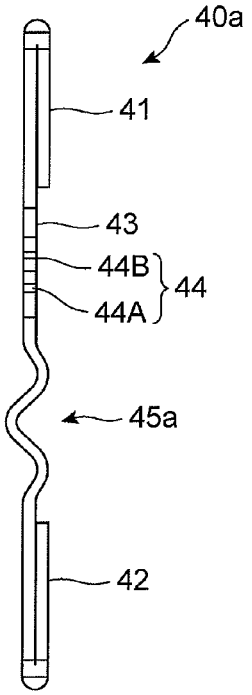
FIG. 18B is a side view of the connector terminal in accordance with the first variant of the connector terminal illustrated in FIG. 4.
Figure 19:
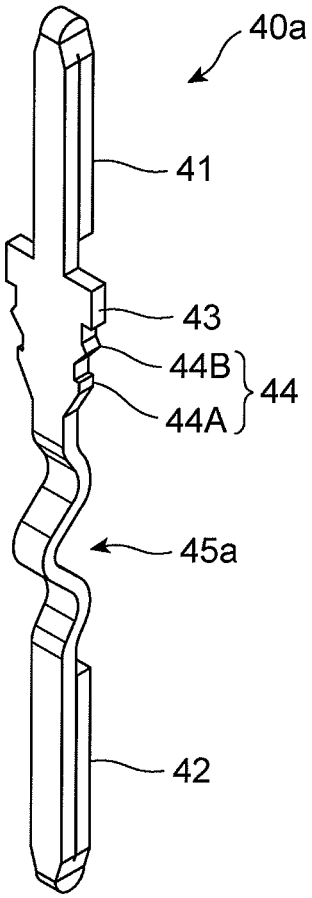
FIG. 19 is a perspective view of the connector terminal illustrated in FIGS. 18A and 18B.

In FIGS. 18A, 18B and 19, parts or elements that correspond to those of the connector terminal illustrated in FIGS. 4A, 4B and 5 have been provided with the same reference numerals, and will not be explained.

As illustrated in FIGS. 18A, 18B and 19, the connector terminal 40*a* in accordance with the first variant is characterized in that a buffer portion 45*a* is curved in a thickness-wise direction of the connector terminal 40*a*.

The buffer portion 45*a* bendable in accordance with the deflection of an axis of the connector terminal 40*a* is designed to be wavy in a thickness-wise direction, that is, designed to be curved alternately in opposite directions in a thickness-wise direction. The wavy buffer portion 45 can be formed by pressing a plate with a raised mold in a direction and with a recessed mold in the opposite direction in a thickness-wise direction.

The connector terminal 40*a* is housed in the terminal storage room 23 of the male housing 20*x* illustrated in FIG. 15 to thereby be inserted into the female connector terminal 50 to electrically connect with the printed circuit board P1.

The buffer portion 45*a* having the above-mentioned structure is difficult to be bendable in a width-wise direction, but easy to be bendable in a thickness-wise direction, ensuring that even if the first and second contacts 42 and 41 are significantly deflected in a thickness-wise direction, the connector terminal 40*a* can be prevented from being buckled due to the excessive insertion into the female connector terminal 50.

(Second Variant of the Connector Terminal)

A connector terminal in accordance with the second variant of the connector terminal 40 is explained hereinbelow with reference to the drawings.

Figure 20A:
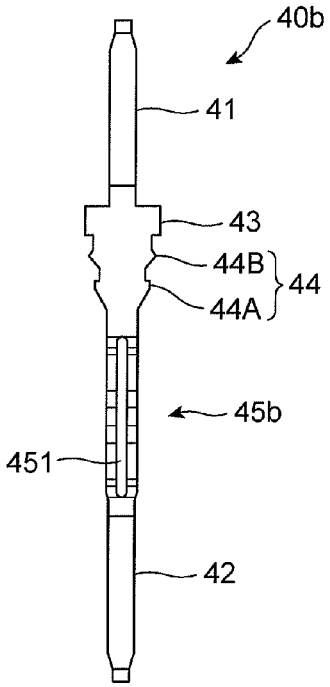
FIG. 20A is a front view of the connector terminal in accordance with the second variant of the connector terminal illustrated in FIG. 4.
Figure 20B:
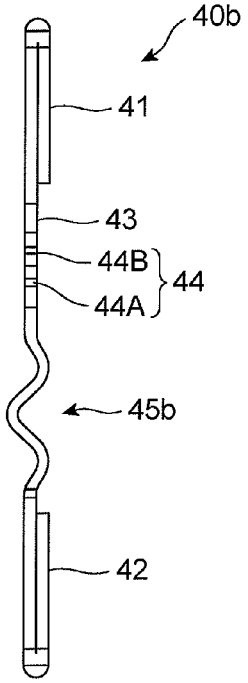
FIG. 20B is a side view of the connector terminal in accordance with the second variant of the connector terminal illustrated in FIG. 4.
Figure 21:
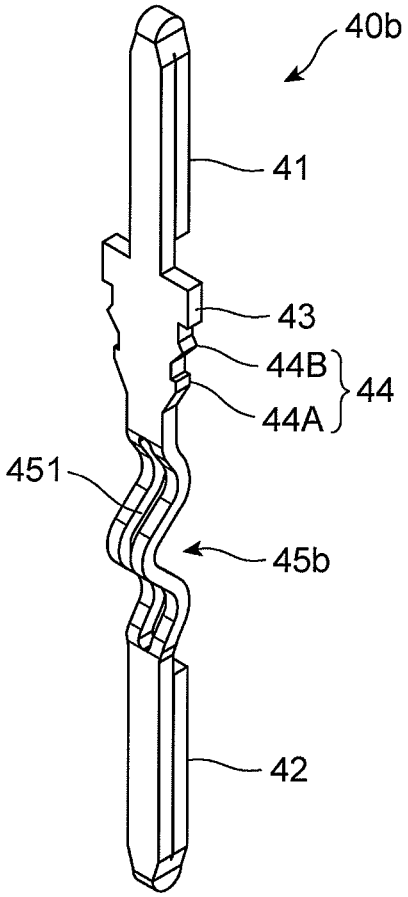
FIG. 21 is a perspective view of the connector terminal illustrated in FIGS. 20A and 20B.

In FIGS. 20A, 20B and 21, parts or elements that correspond to those of the connector terminal illustrated in FIGS. 4A, 4B, 5, 18A, 18B and 19 have been provided with the same reference numerals, and will not be explained.

As illustrated in FIGS. 20A, 20B and 21, a connector terminal 40*b* in accordance with the second variant is characterized in that a buffer portion 45*b* is curved in a thickness-wise direction, and the buffer portion 45*b* is formed with a slit 451 extending in a length-wise direction.

Similarly to the first variant (see FIGS. 18A, 18B and 19), the buffer portion 45*b* bendable in accordance with the deflection in an axis of the connector terminal 40*b* is designed wavy in a thickness-wise direction, that is, curved alternately in opposite directions in a thickness-wise direction. The slit 451 extending in a length-wise direction divides the buffer portion 45*b* into two resilient pieces both of which are in the form of a thin plate.

By inserting the connector terminal 40*b* into the terminal storage room 23 of the male housing 20 illustrated in FIGS. 9 to 12, the connector terminal 40*b* can be inserted into the printed circuit board P1 through the female housing 30 to thereby electrically connect to the printed circuit board P1. As an alternative, by inserting the connector terminal 40*b* into the terminal storage room 23 of the male housing 20*x* illustrated in FIG. 15, the connector terminal 40*b* can be inserted into the female connector terminal 50 illustrated in FIG. 15 to thereby electrically connect to the printed circuit board P1.

As mentioned above, merely by forming the buffer portion 45*b* with the slit 451 extending in a length-wise direction, the buffer portion 45*b* can be readily bendable not only in a thickness-wise direction, but also in a width-wise direction.

Though the connector terminal 40*b* in accordance with the second variant is designed to include the single slit 451 to thereby divide the buffer portion 45*b* into two resilient pieces, it should be noted that the connector terminal 40*b* may be formed with two or more slits in dependence on a width of the buffer portion 45*b* to thereby divide the buffer portion 45*b* into three or more resilient pieces.

(Third Variant of the Connector Terminal)

A connector terminal in accordance with the third variant of the connector terminal 40 is explained hereinbelow with reference to the drawings.

Figure 22A:
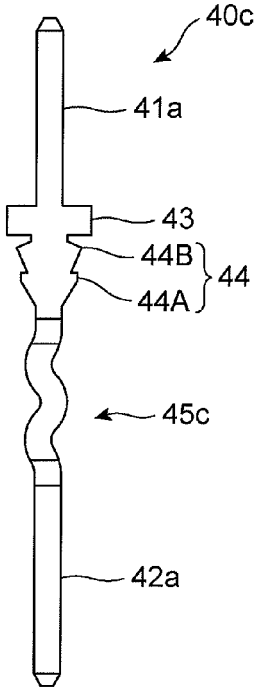
FIG. 22A is a front view of the connector terminal in accordance with the third variant of the connector terminal illustrated in FIG. 4.
Figure 22B:
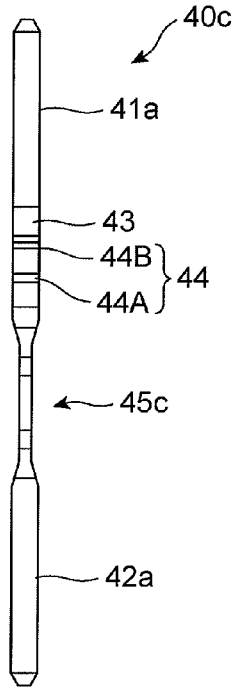
FIG. 22B is a side view of the connector terminal in accordance with the third variant of the connector terminal illustrated in FIG. 4.
Figure 23:
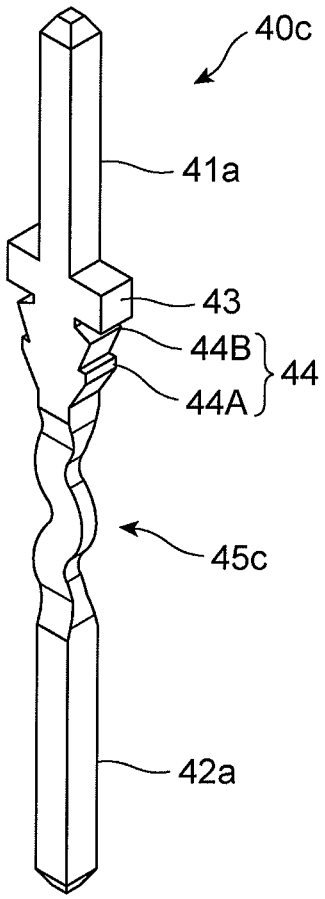
FIG. 23 is a perspective view of the connector terminal illustrated in FIGS. 22A and 22B.

In FIGS. 22A, 22B and 23, parts or elements that correspond to those of the connector terminal illustrated in FIGS. 4A, 4B and 5 have been provided with the same reference numerals, and will not be explained.

As illustrated in FIGS. 22A, 22B and 23, a connector terminal 40*c* in accordance with the third variant is characterized in that a buffer portion 45*c* is curved in a width-wise direction, and the buffer portion 45*c* is hammered by pressing to thereby have a thickness smaller than the same of the first and second contacts 42*a* and 41*a*.

The first and second contacts 42*a* and 41*a* are designed to have an almost square cross-section. The buffer portion 45*c* is pressed to thereby be rolled to have an increased length and a reduced thickness. A cross-section of the buffer portion 45*c* is turned from an almost square one to an almost rectangular one. Similarly to the connector terminal 40 in accordance with the first embodiment, the buffer portion 45*c* is designed wavy, that is, curved in opposite directions in a width-wise direction.

By inserting the connector terminal 40*c* into the terminal storage room 23 of the male housing 20 illustrated in FIGS. 9 to 12, the connector terminal 40*c* can be inserted into the printed circuit board P1 through the female housing 30 to thereby electrically connect to the printed circuit board P1. As an alternative, by inserting the connector terminal 40*c* into the terminal storage room 23 of the male housing 20*x* illustrated in FIG. 15, the connector terminal 40*c* can be inserted into the female connector terminal 50 illustrated in FIG. 15 to thereby electrically connect to the printed circuit board P1.

As mentioned above, the buffer portion 45*c* can be designed to have a thickness smaller than the same of the first and second contacts 42*a* and 41*a* by pressing to thereby hammer the buffer portion 45*c*, and thus, the buffer portion 45*c* can be more bendable than the first and second contacts 42*a* and 41*a*. Thus, the connector terminal 40*c* can absorb the deflection in an axis thereof, even if the deflection is slight.

Since the buffer portion 45*c* in the third variant is pressed to thereby be hammered to have a reduced thickness, a width of the pressed buffer portion is greater than the non-pressed buffer portion. If the buffer portion 45*c* were designed to have a thickness sufficiently smaller than the same of the first and second contacts 42*a* and 41*a*, the buffer portion 45*c* may be designed to be broad in width.

(Fourth Variant of the Connector Terminal)

A connector terminal in accordance with the fourth variant of the connector terminal 40 is explained hereinbelow with reference to the drawings.

Figure 24A:
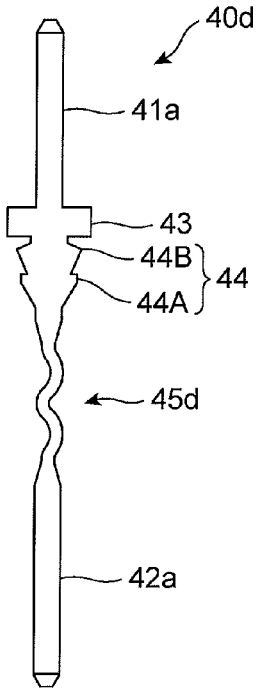
FIG. 24A is a front view of the connector terminal in accordance with the fourth variant of the connector terminal illustrated in FIG. 4.
Figure 24B:
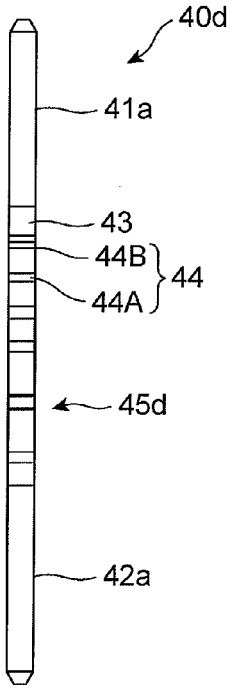
FIG. 24B is a side view of the connector terminal in accordance with the fourth variant of the connector terminal illustrated in FIG. 4.
Figure 25:
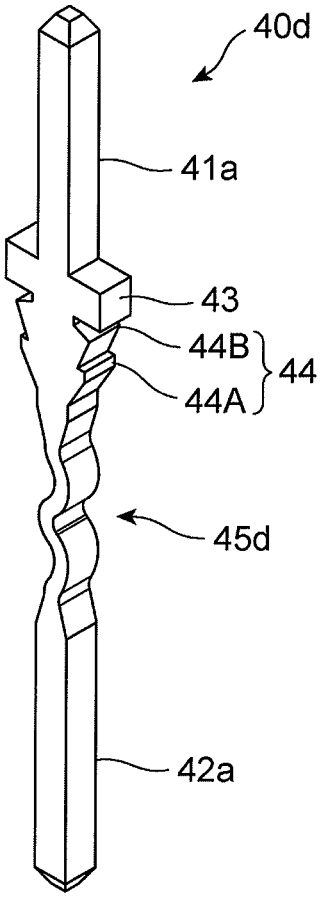
FIG. 25 is a perspective view of the connector terminal illustrated in FIGS. 24A and 24B.

In FIGS. 24A, 24B and 25, parts or elements that correspond to those of the connector terminal illustrated in FIGS. 4A, 4B, 5, 22A, 22B and 23 have been provided with the same reference numerals, and will not be explained.

As illustrated in FIGS. 24A, 24B and 25, a connector terminal 40*d* in accordance with the fourth variant is characterized in that a buffer portion 45*d* is curved in a width-wise direction, and the buffer portion 45*d* is pressed to be hammered at a width to thereby have a width smaller than the same of the first and second contacts 42*a* and 41*a*.

The buffer portion 45*d* bendable in accordance with the deflection in an axis of the connector terminal 40*d* is designed wavy, that is, curved in opposite directions in a width-wise direction. The wavy buffer portion 45*d* can be designed to have a width smaller than the same of the first and second contacts 42*a* and 41*a* by punching the buffer portion 45*d* in a width-wise direction.

By inserting the connector terminal 40*d* into the terminal storage room 23 of the male housing 20*x* illustrated in FIG. 15, the connector terminal 40*d* can be inserted into the female connector terminal 50 illustrated in FIG. 15 to thereby electrically connect to the printed circuit board P1.

The buffer portion 45*d* having the above-mentioned structure is easy to be bendable in a width-wise direction, ensuring that even if the first and second contacts 42*a* and 41*a* are significantly deflected in a width-wise direction, the connector terminal 40*d* can be prevented from being buckled due to the excessive insertion into the female connector terminal 50.

(Fifth Variant of the Connector Terminal)

A connector terminal in accordance with the fifth variant of the connector terminal 40 is explained hereinbelow with reference to the drawings.

Figure 26A:
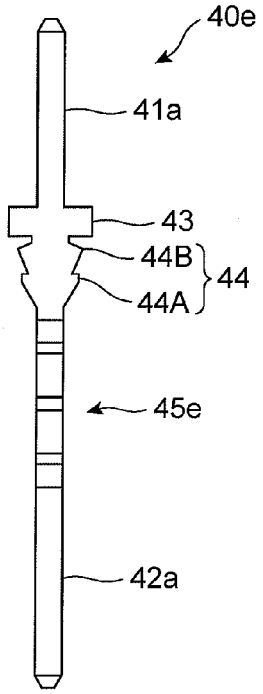
FIG. 26A is a front view of the connector terminal in accordance with the fifth variant of the connector terminal illustrated in FIG. 4.
Figure 26B:
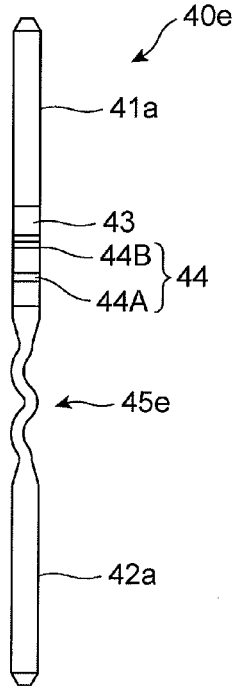
FIG. 26B is a side view of the connector terminal in accordance with the fifth variant of the connector terminal illustrated in FIG. 4.
Figure 27:
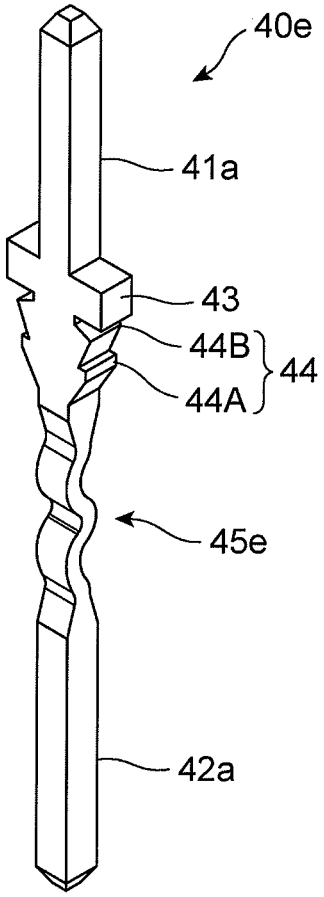
FIG. 27 is a perspective view of the connector terminal illustrated in FIGS. 26A and 26B.

In FIGS. 26A, 26B and 27, parts or elements that correspond to those of the connector terminal illustrated in FIGS. 4A, 4B, 5, 18A, 18B and 19 have been provided with the same reference numerals, and will not be explained.

As illustrated in FIGS. 26A, 26B and 27, a connector terminal 40*e* in accordance with the fifth variant is characterized in that a buffer portion 45*e* is curved in a thickness-wise direction, similarly to the first variant (see FIGS. 18A, 18B and 19), and the buffer portion 45*e* is pressed to thereby be collapsed in a thickness-wise direction to have a thickness smaller than the same of the first and second contacts 42*a* and 41*a*.

The buffer portion 45*e* deformable in accordance with the deflection in an axis of the connector terminal 40*e* is designed wavy, that is, curved in opposite directions in a thickness-wise direction. The wavy buffer portion 45*e* can be formed by pressing the buffer portion to be collapsed in a thickness-wise direction to thereby cause the buffer portion to have a thickness smaller than the first and second contacts 42*a* and 41*a*, and pressing the buffer portion with a raised mold in a direction and with a recessed mold in the opposite direction in a thickness-wise direction.

By inserting the connector terminal 40*e* into the terminal storage room 23 of the male housing 20*x* illustrated in FIG. 15, the connector terminal 40*e* can be inserted into the female connector terminal 50 illustrated in FIG. 15 to thereby electrically connect to the printed circuit board P1.

The buffer portion 45*e* having the above-mentioned structure is easy to be deformable in a thickness-wise direction, ensuring that even if the first and second contacts 42*a* and 41*a* are so much deflected in a thickness-wise direction, the connector terminal 40*e* can be prevented from being buckled due to the excessive insertion into the female connector terminal 50.

(Sixth Variant of the Connector Terminal)

A connector terminal in accordance with the sixth variant of the connector terminal 40 is explained hereinbelow with reference to the drawings.

Figure 28A:
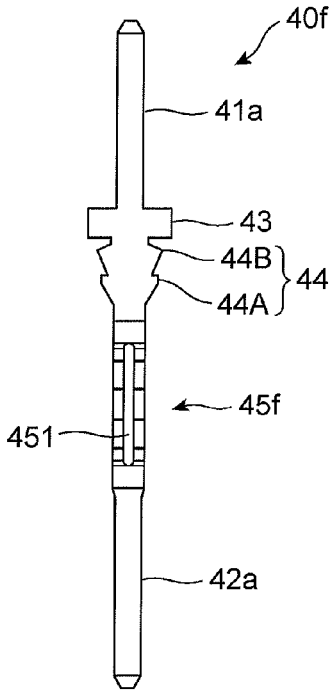
FIG. 28A is a front view of the connector terminal in accordance with the sixth variant of the connector terminal illustrated in FIG. 4.
Figure 28B:
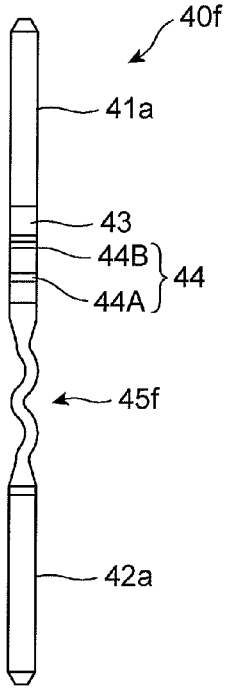
FIG. 28B is a side view of the connector terminal in accordance with the sixth variant of the connector terminal illustrated in FIG. 4.
Figure 29:
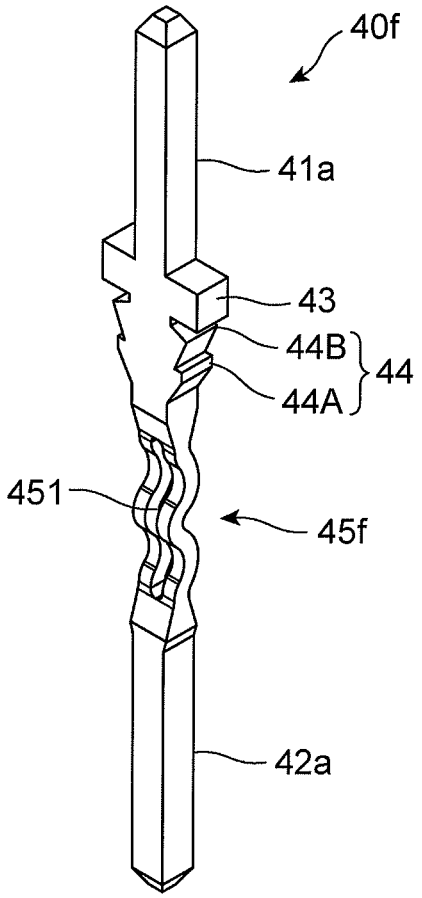
FIG. 29 is a perspective view of the connector terminal illustrated in FIGS. 28A and 28B.
Figure 30:
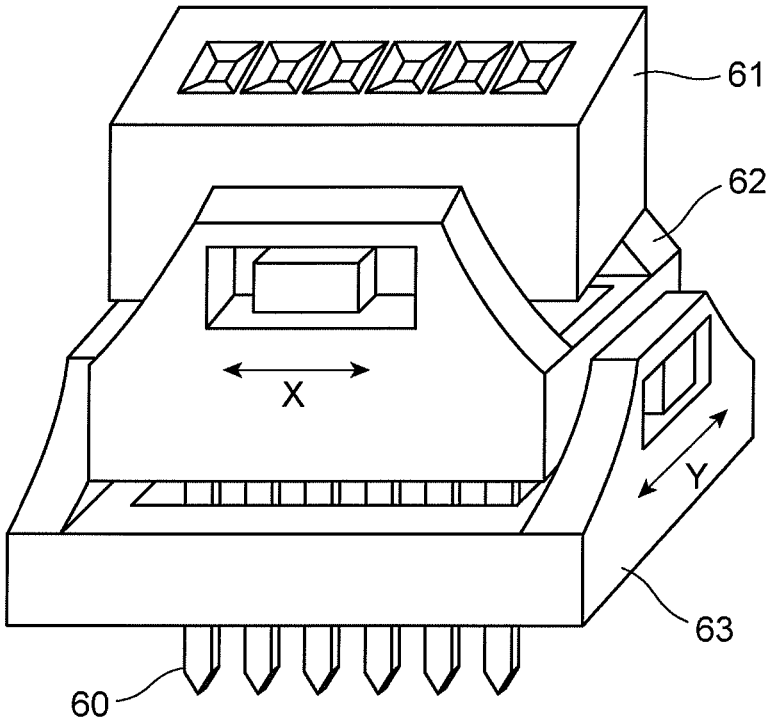
FIG. 30 PRIOR ART
FIG. 30 is a perspective view of the conventional electric connector.
Figure 31:
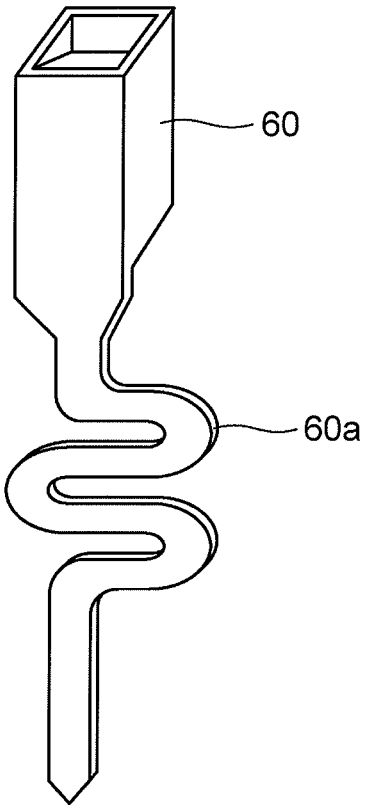
FIG. 31 PRIOR ART
FIG. 31 is an enlarged view of the terminal used in the conventional electric connector illustrated in FIG. 30.
Figure 32:
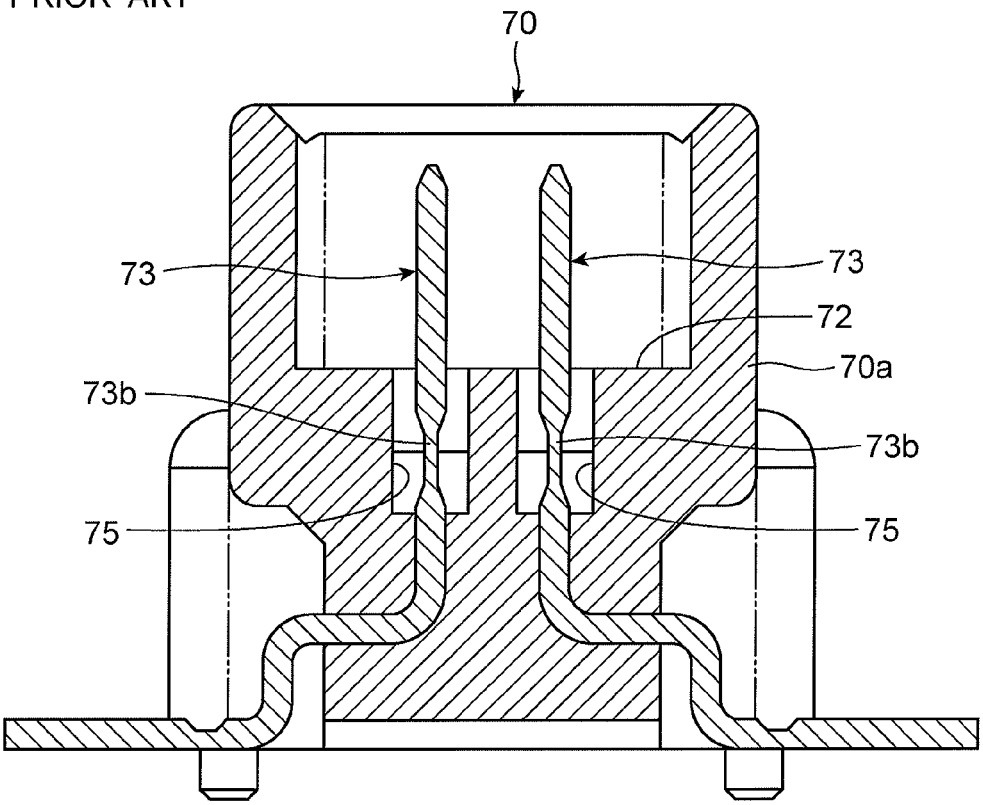
FIG. 32 PRIOR ART
FIG. 32 is a cross-sectional view of the conventional male connector.

In FIGS. 28A, 28B and 29, parts or elements that correspond to those of the connector terminal illustrated in FIGS. 4A, 4B, 5, 20A, 20B, 21, 26A, 26B and 27 have been provided with the same reference numerals, and will not be explained.

As illustrated in FIGS. 28A, 28B and 20, a connector terminal 40*f* in accordance with the sixth variant is characterized in that a buffer portion 45*f* is curved in a thickness-wise direction, similarly to the fifth variant (see FIGS. 26A, 26B and 27), the buffer portion 45*f* is pressed to thereby be hammered in a thickness-wise direction to have a thickness smaller than the same of the first and second contacts 42*a* and 41*a*, and the buffer portion 45*b* is formed with a slit 451 extending in a length-wise direction of the connector terminal 40*f*, similarly to the second variant (see FIGS. 20A, 20B and 21).

The buffer portion 45*f* bendable in accordance with the deflection in an axis of the connector terminal 40*f* is designed wavy, that is, curved in opposite directions in a thickness-wise direction. The wavy buffer portion 45*f* can be formed by pressing the buffer portion to be hammered in a thickness-wise direction to thereby cause the buffer portion to have a thickness greater than the first and second contacts 42*a* and 41*a*, unlike the first variant, and pressing the buffer portion with a raised mold in a direction and with a recessed mold in the opposite direction in a thickness-wise direction.

The slit 451 extending in a length-wise direction divides the buffer portion 45*f* into two resilient pieces both of which are in the form of a thin plate.

By inserting the connector terminal 40*f* into the terminal storage room 23 of the male housing 20 illustrated in FIGS. 9 to 12, the connector terminal 40*f* can be inserted into the printed circuit board P1 through the female housing 30 to thereby electrically connect to the printed circuit board P1. As an alternative, by inserting the connector terminal 40*f* into the terminal storage room 23 of the male housing 20*x* illustrated in FIG. 15, the connector terminal 40*f* can be inserted into the female connector terminal 50 illustrated in FIG. 15 to thereby electrically connect to the printed circuit board P1.

As mentioned above, merely by forming the buffer portion 45*f* with the slit 451 extending in a length-wise direction, the buffer portion 45*f* can be readily bent not only in a thickness-wise direction, but also in a width-wise direction.

Though the electric connectors in accordance with the first and second embodiments and the connector terminals in accordance with the first to sixth variants have been explained so far, it should be noted that the subject matter of the present invention is not to be limited to those specific embodiments.

For instance, though the buffer portions 45 and 45*a* to 45*f* in the connector terminals 40 and 40*a* to 40*f* are designed to be curved in a width-wise or thickness-wise direction, they may be designed to be curved in both width-wise and thickness-wise directions, in which case, the buffer portion may be curved in a thickness-wise direction at a curvature greater than a curvature at which the buffer portion is curved in a width-wise direction, or vice versa.

INDUSTRIAL APPLICABILITY

The electric connector in accordance with the present invention can be used in various fields such as electrical and electronic fields and a field of an automobile, as a connector to be used for electric and electronic parts or a connector to be mounted in an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2012-211374 filed on Sep. 25, 2012 including specification, claims, drawings and summary is incorporated herein by reference in its entirety.

What is claimed is:

1. An electric connector comprising:

a connector terminal including a first contact at one end, a second contact at the other end, and a buffer portion, said connector terminal electrically connecting a first object connected to said first contact to a second object connected to said second contact, said buffer portion being bent in accordance with a positional gap between said first and second objects, and said buffer portion being smaller in one of thickness and width than each of said first and second contacts;

a first housing mounted on said first object, said connector terminal being housed in said first housing;

a second housing formed with a through-hole into which said second contact is inserted, said second housing including a guide for introducing said second contact to said through-hole when said second contact is inserted into said through-hole, wherein said second housing has a hollow space into which said first housing is fit.

2. The electric connector as set forth in claim 1, wherein said buffer portion is curved in at least one of a width-wise direction and a thickness-wise direction thereof.

3. The electric connector as set forth in claim 1, wherein said buffer portion is formed with at least one slit extending in a length-wise direction thereof.

4. The electric connector as set forth in claim 1, wherein said first and second contacts are comprised of at least two layers of a folded plate to be thicker than said buffer portion.

5. The electric connector as set forth in claim 1, wherein said buffer portion is pressed to be buckled or punched to thereby be smaller in one of thickness and width than each of said first and second contacts.

6. The electric connector as set forth in claim 1, wherein said guide includes:

a hole leading to said through-hole; and a slope downwardly inclining in a direction in which said first contact is inserted into said through-hole, and making contact at a lower end thereof with an upper end of said hole.

7. The electric connector as set forth in claim 1, wherein a plurality of said connector terminals is arranged in a line, said electric connector includes a plurality of said guides in accordance with said plurality of said connector terminals, and each of said guides has a rectangular entrance opening, said guides being arranged in a line such that an entrance opening of a first guide is located close to an entrance opening of a second guide disposed adjacent to said first guide.

* * * * *